US008002367B2

(12) United States Patent
Kim et al.

(10) Patent No.: US 8,002,367 B2
(45) Date of Patent: Aug. 23, 2011

(54) FOOD REFRIGERATOR

(75) Inventors: Hyoung Woo Kim, Seoul (KR); Kyung Ho Park, Chungnam (KR); Hi-In Shin, Seoul (KR); Seok Jae Choi, Chungnam (KR)

(73) Assignee: Winiamando Inc., Asan (KR)

( * ) Notice: Subject to any disclaimer, the term of this patent is extended or adjusted under 35 U.S.C. 154(b) by 483 days.

(21) Appl. No.: 11/843,240

(22) Filed: Aug. 22, 2007

(65) Prior Publication Data

US 2008/0047295 A1 Feb. 28, 2008

(30) Foreign Application Priority Data

Aug. 24, 2006 (KR) ..... 10-2006-0080760
Aug. 24, 2006 (KR) ..... 10-2006-0080764
Aug. 24, 2006 (KR) ..... 10-2006-0080812
Oct. 13, 2006 (KR) ..... 10-2006-0099768

(51) Int. Cl.
*A47B 96/04* (2006.01)

(52) U.S. Cl. ..... 312/401; 312/111; 312/334.8; 312/333; 312/290

(58) Field of Classification Search ..... 312/107, 312/108, 111, 402, 401, 334.7, 334.8, 333, 312/290, 408; 62/441, 443, 449, 465
See application file for complete search history.

(56) References Cited

U.S. PATENT DOCUMENTS 2,429,294 A * 10/1947 Pollock ..... 62/442
2,815,649 A * 12/1957 Di Angelus et al. ..... 312/408
3,207,565 A * 9/1965 Scharge ..... 312/204
4,759,193 A * 7/1988 Dehring ..... 62/258
5,747,734 A * 5/1998 Kozlowski et al. ..... 174/50
6,253,668 B1 * 7/2001 Lee ..... 99/468
6,666,045 B1 * 12/2003 Song ..... 62/441
6,846,053 B2 * 1/2005 Salice ..... 312/334.14
6,953,233 B2 * 10/2005 Lam et al. ..... 312/333
6,971,730 B2 * 12/2005 Koons ..... 312/404
7,040,113 B2 * 5/2006 Lee et al. ..... 62/407
7,472,973 B2 * 1/2009 Huang ..... 312/333
2001/0035704 A1 * 11/2001 Dierbeck ..... 312/902
2004/0035142 A1 * 2/2004 Yoon et al. ..... 62/441
2004/0161572 A1 * 8/2004 Juran et al. ..... 428/41.8
2005/0022547 A1 * 2/2005 Lee et al. ..... 62/258
2005/0127804 A1 * 6/2005 Kim et al. ..... 312/402
2005/0225221 A1 * 10/2005 Song et al. ..... 312/401
2006/0108902 A1 * 5/2006 Lowery et al. ..... 312/404
2006/0113169 A1 * 6/2006 Leon et al. ..... 200/5 R
2006/0130514 A1 * 6/2006 Kim ..... 62/446
2007/0169505 A1 * 7/2007 Kim et al. ..... 62/441
2007/0262686 A1 * 11/2007 Ji ..... 312/402

FOREIGN PATENT DOCUMENTS

KR 20-2003-0029084 12/2003
KR 1020060060349 6/2006
KR 1020060094586 8/2006

* cited by examiner

*Primary Examiner* — Janet M Wilkens
*Assistant Examiner* — Dan Rohrhoff
(74) *Attorney, Agent, or Firm* — Lucas & Mercanti, LLP

(57) ABSTRACT

A food refrigerator including a refrigerator compartment for storing therein kimchi, fruit, vegetables, greens, drinking water, wine, beer, etc., and an accessory storage compartment for storing therein a variety of accessories related to the use of the food stored in the refrigerator unit.

16 Claims, 22 Drawing Sheets

[FIG. 1]
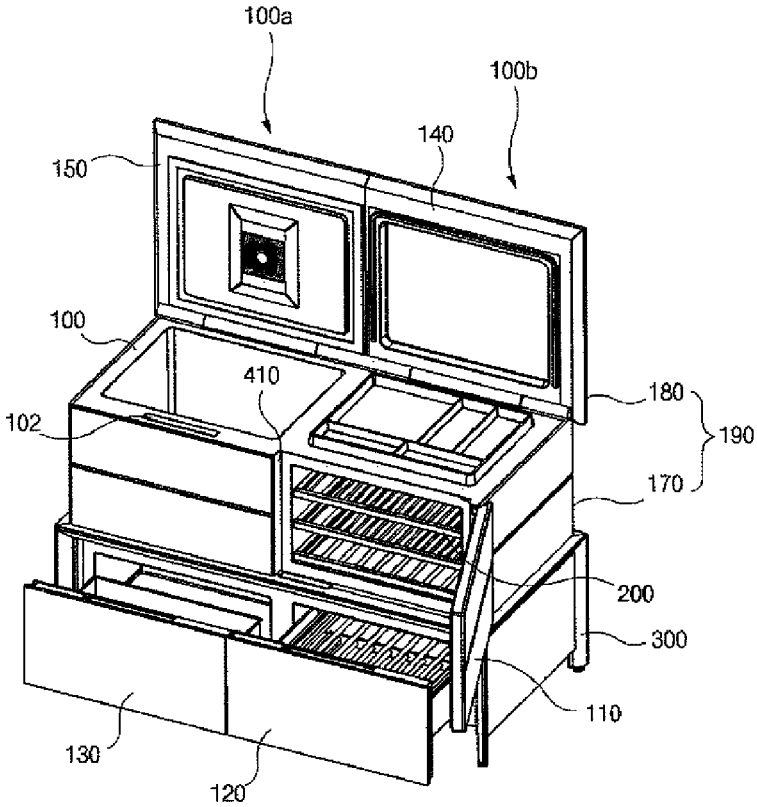
[FIG. 2]
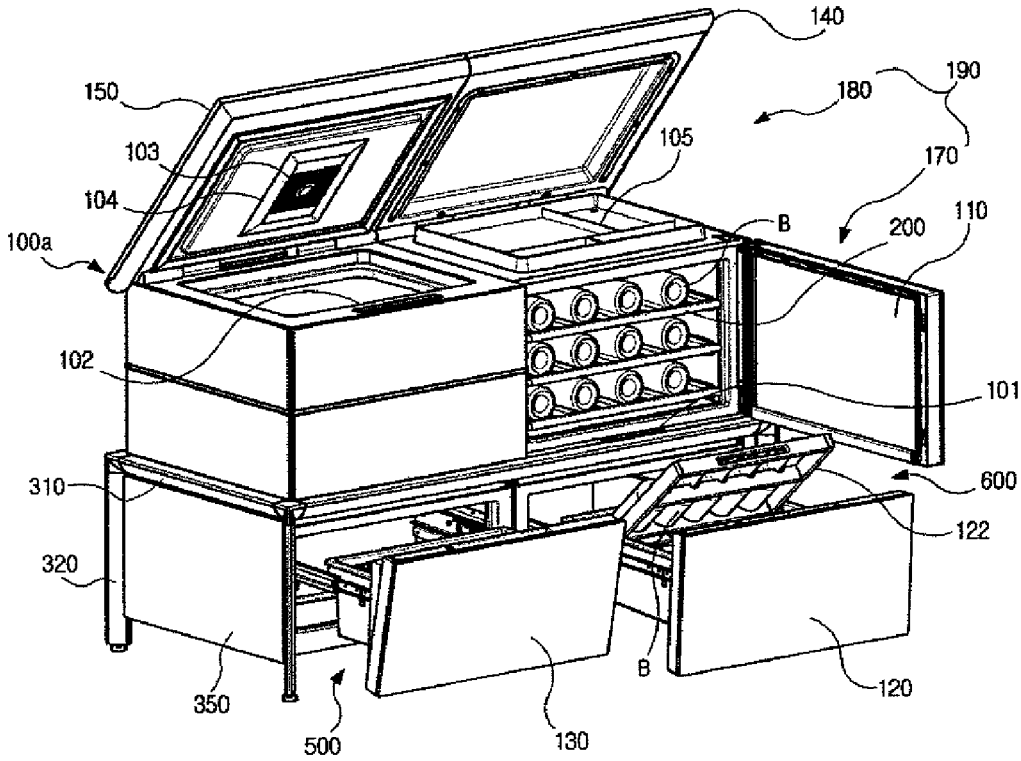

[FIG. 3]
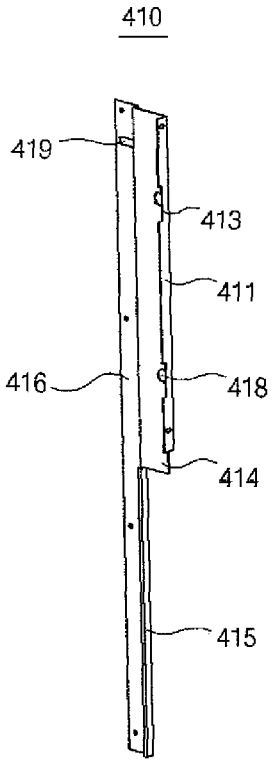
[FIG. 4]
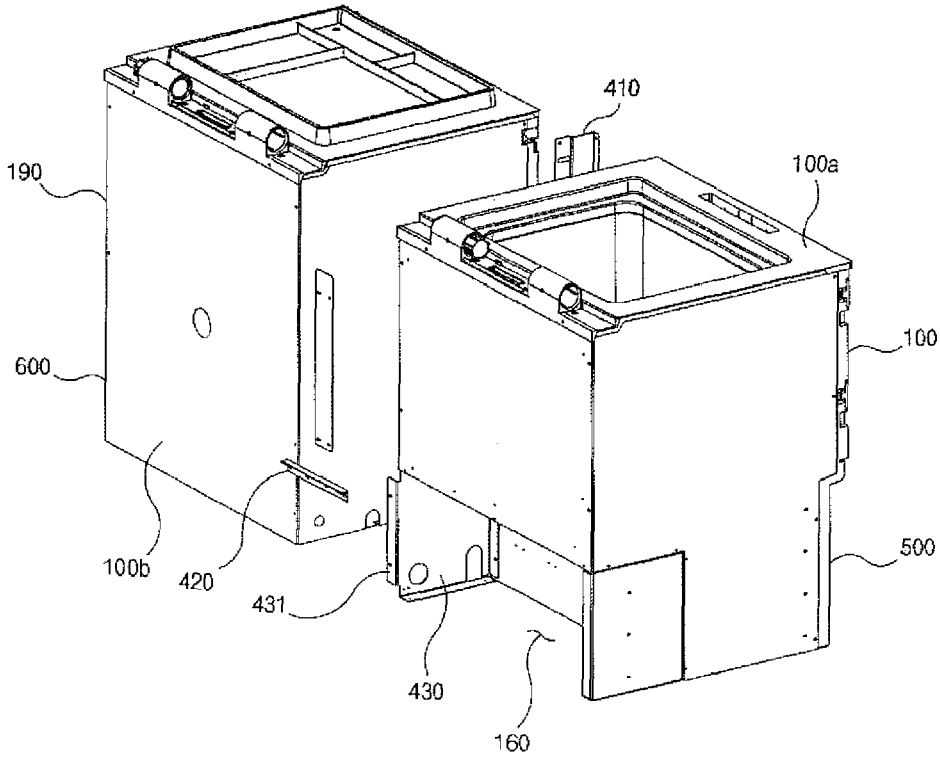

[FIG. 5]
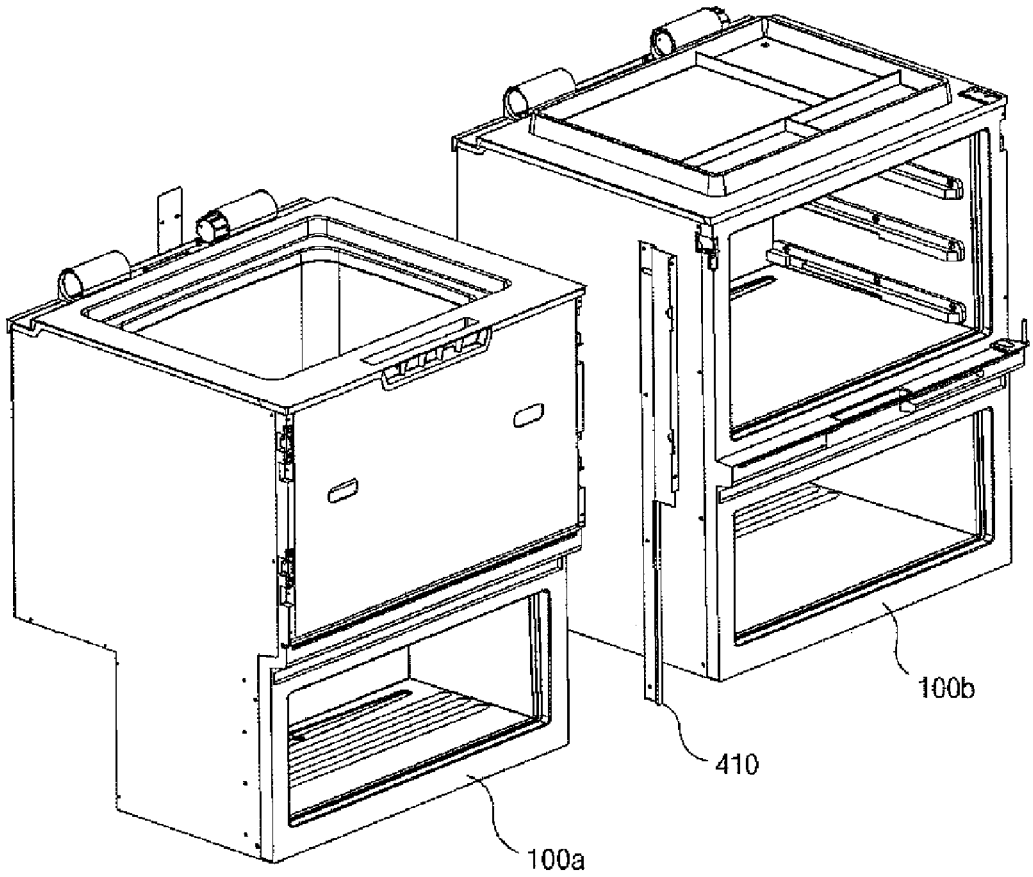
[FIG. 6]
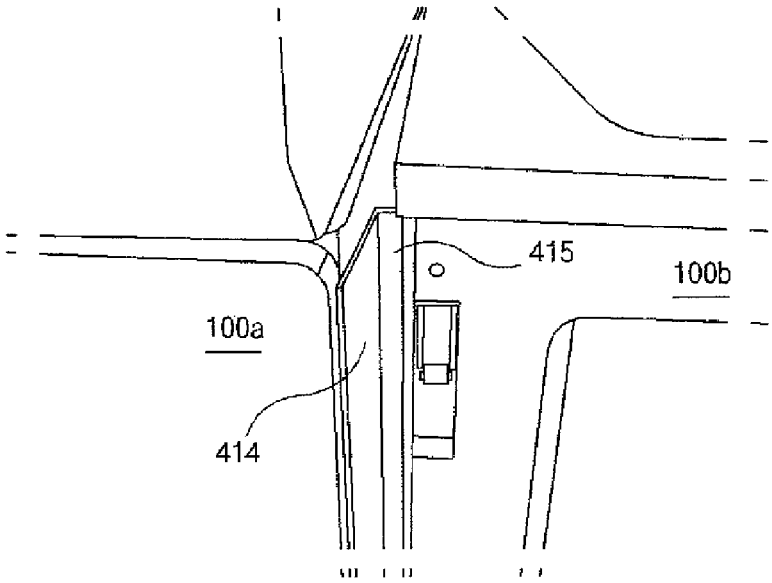

[FIG. 7]
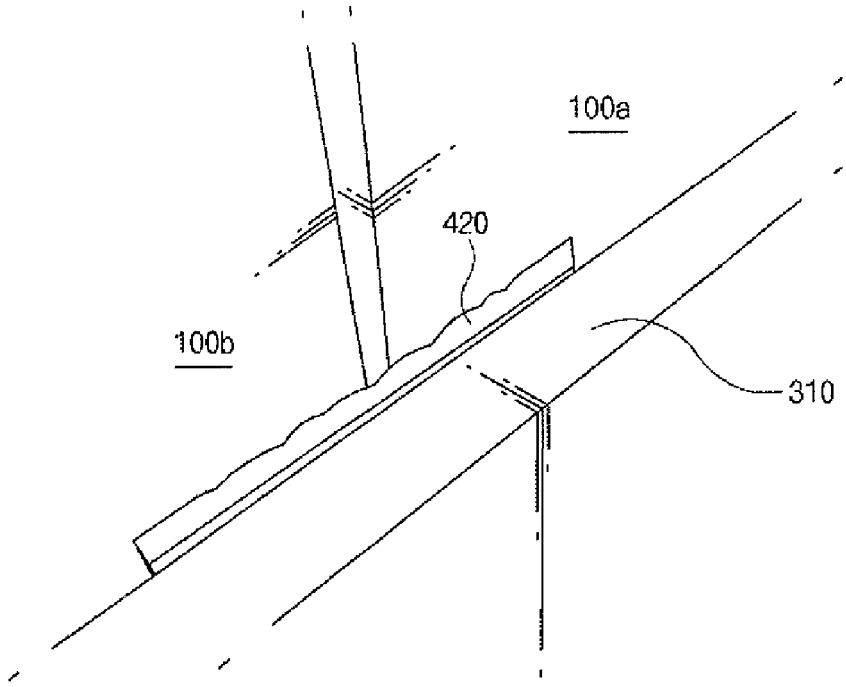
[FIG. 8]
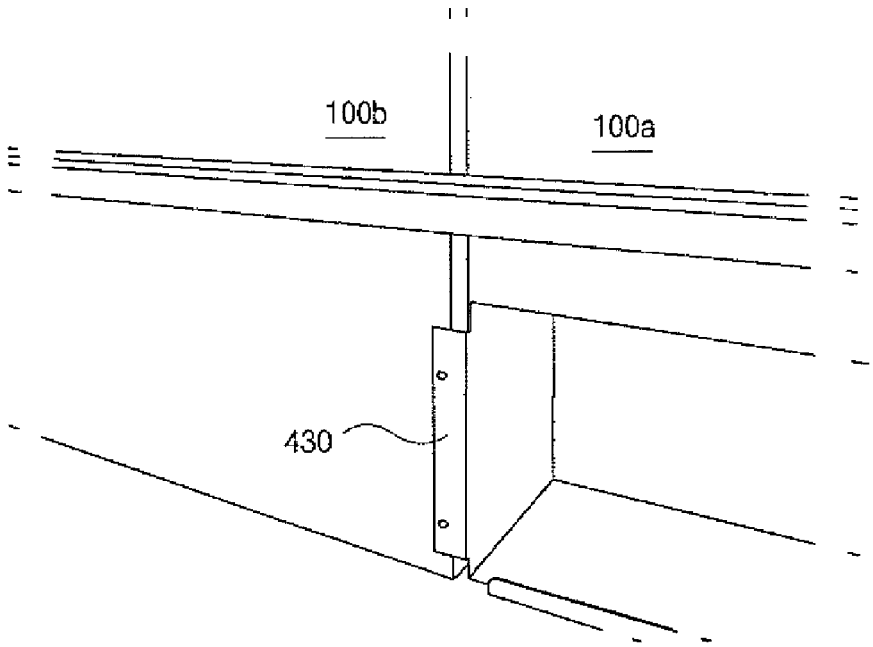

[FIG. 9]
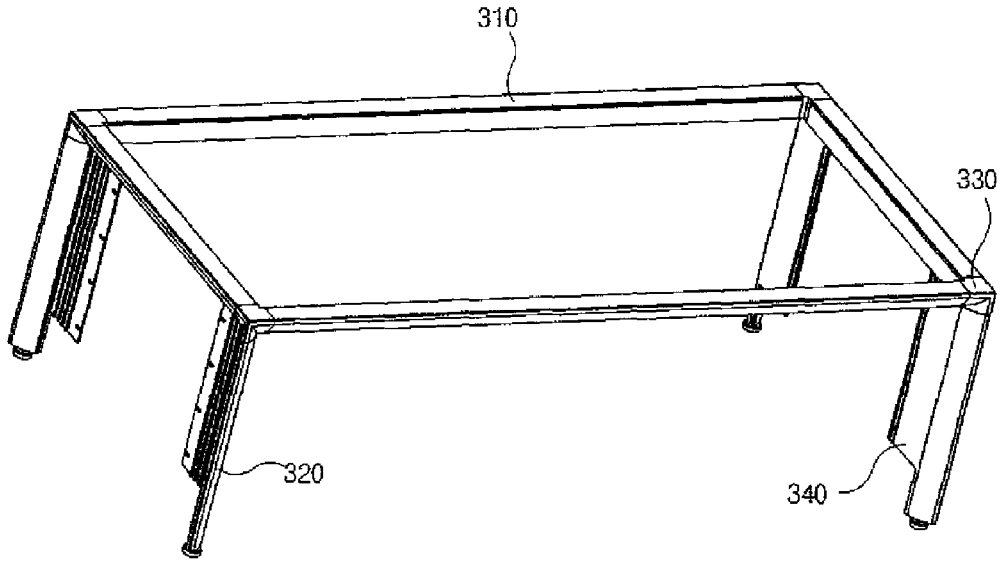
[FIG. 10]
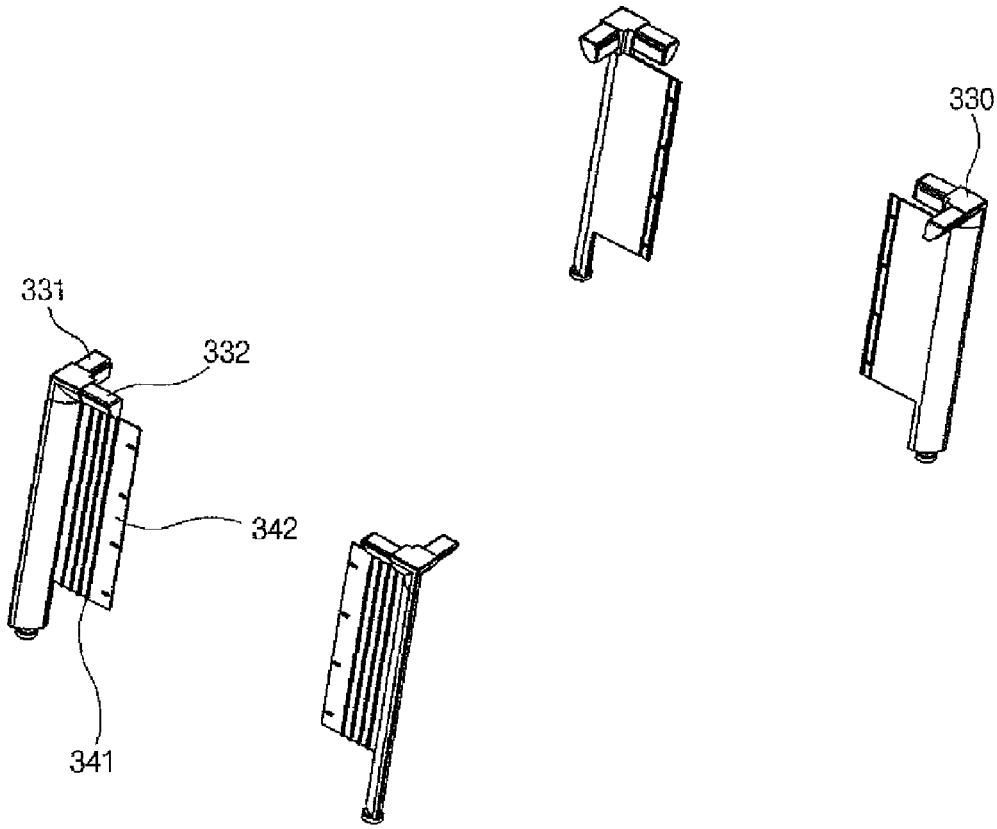

[FIG. 11]
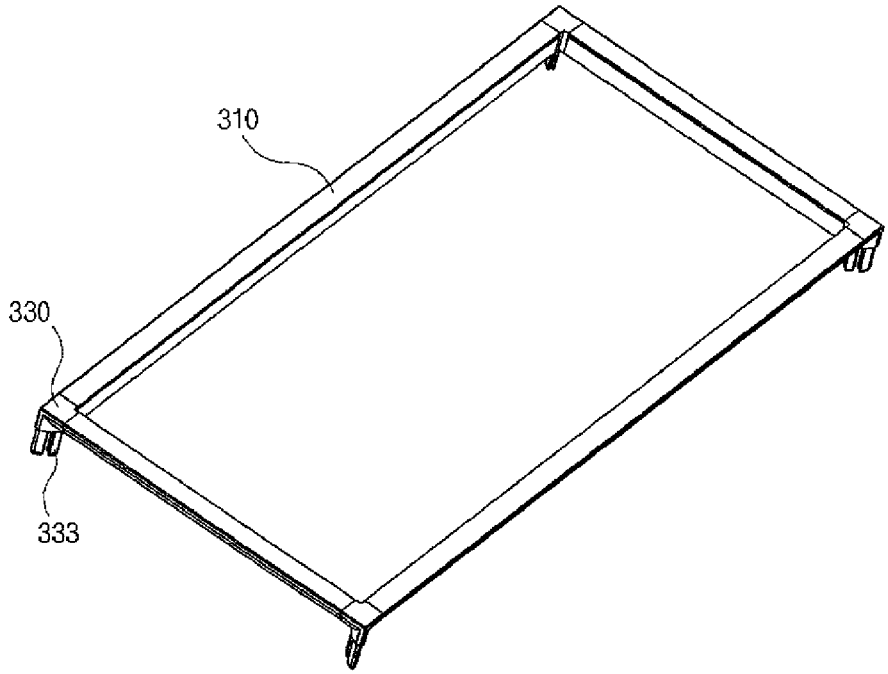
[FIG. 12]
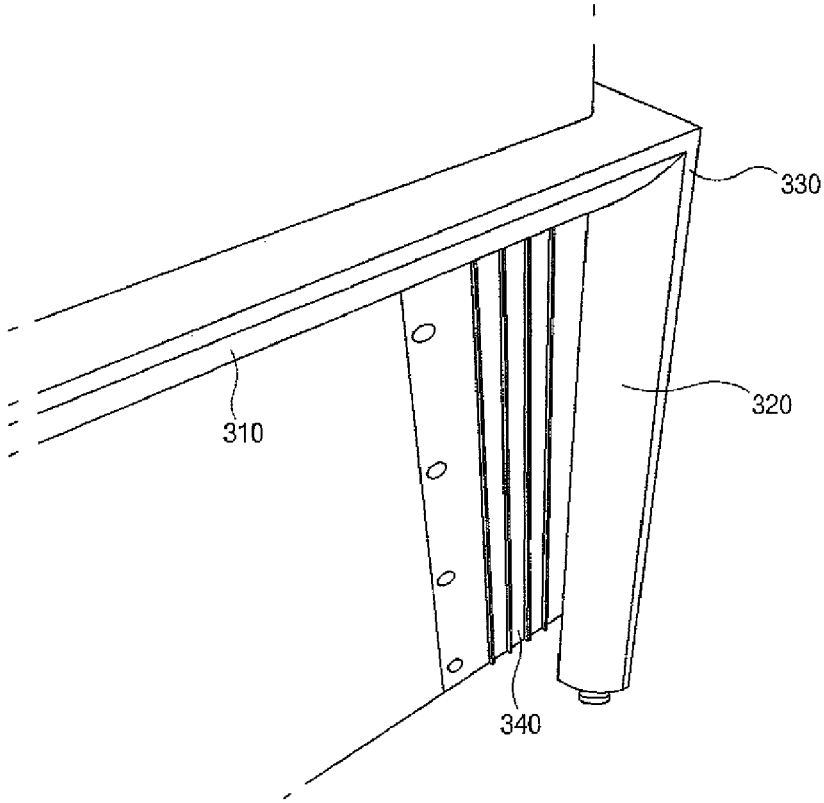

[FIG. 13]
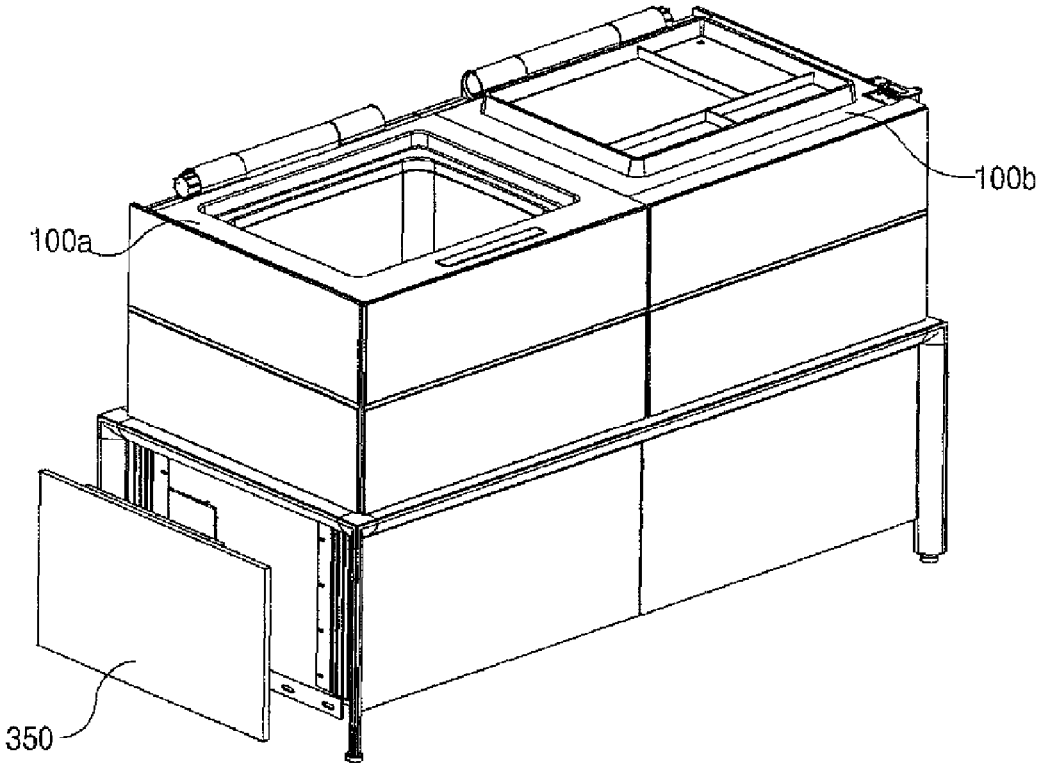
[FIG. 14]
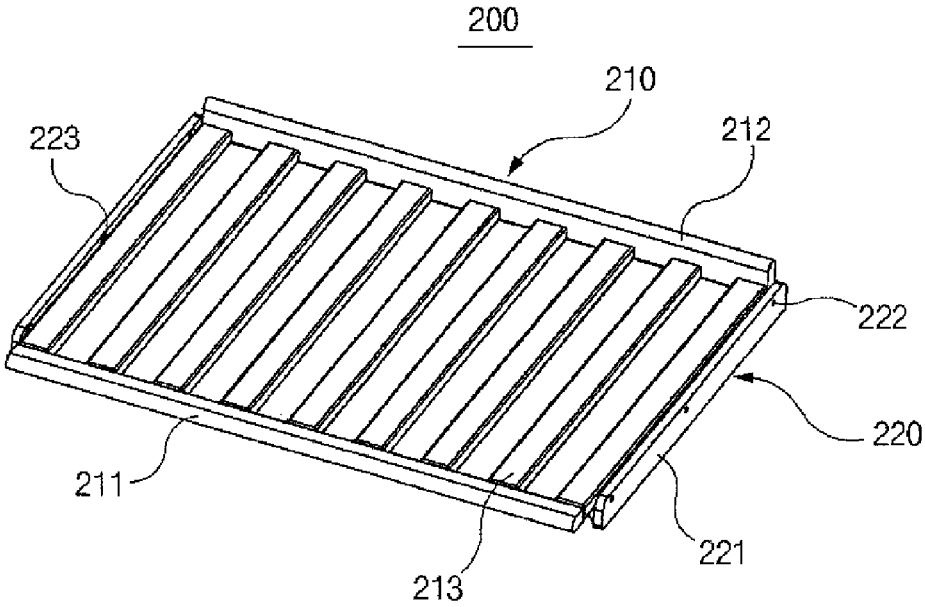

[FIG. 15]
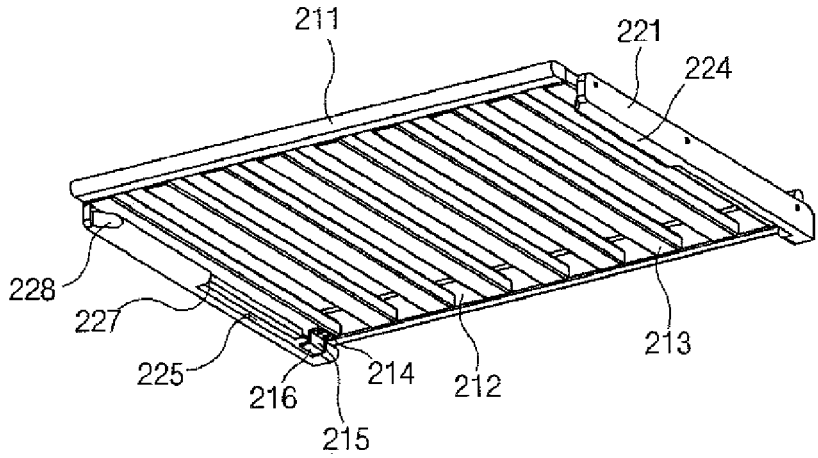
[FIG. 16]
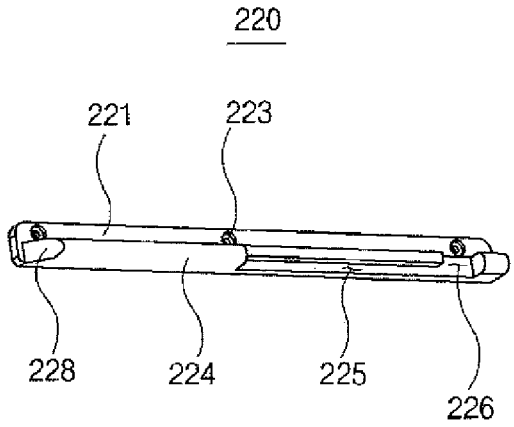
[FIG. 17]
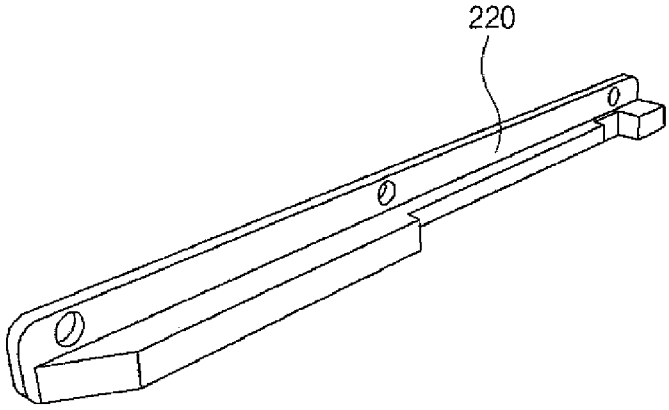

[FIG. 18]
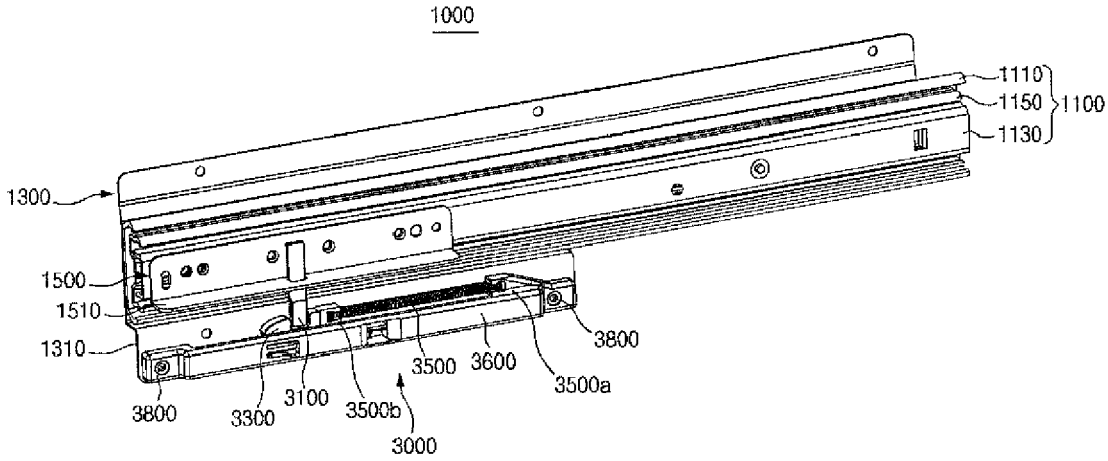

[FIG. 19]
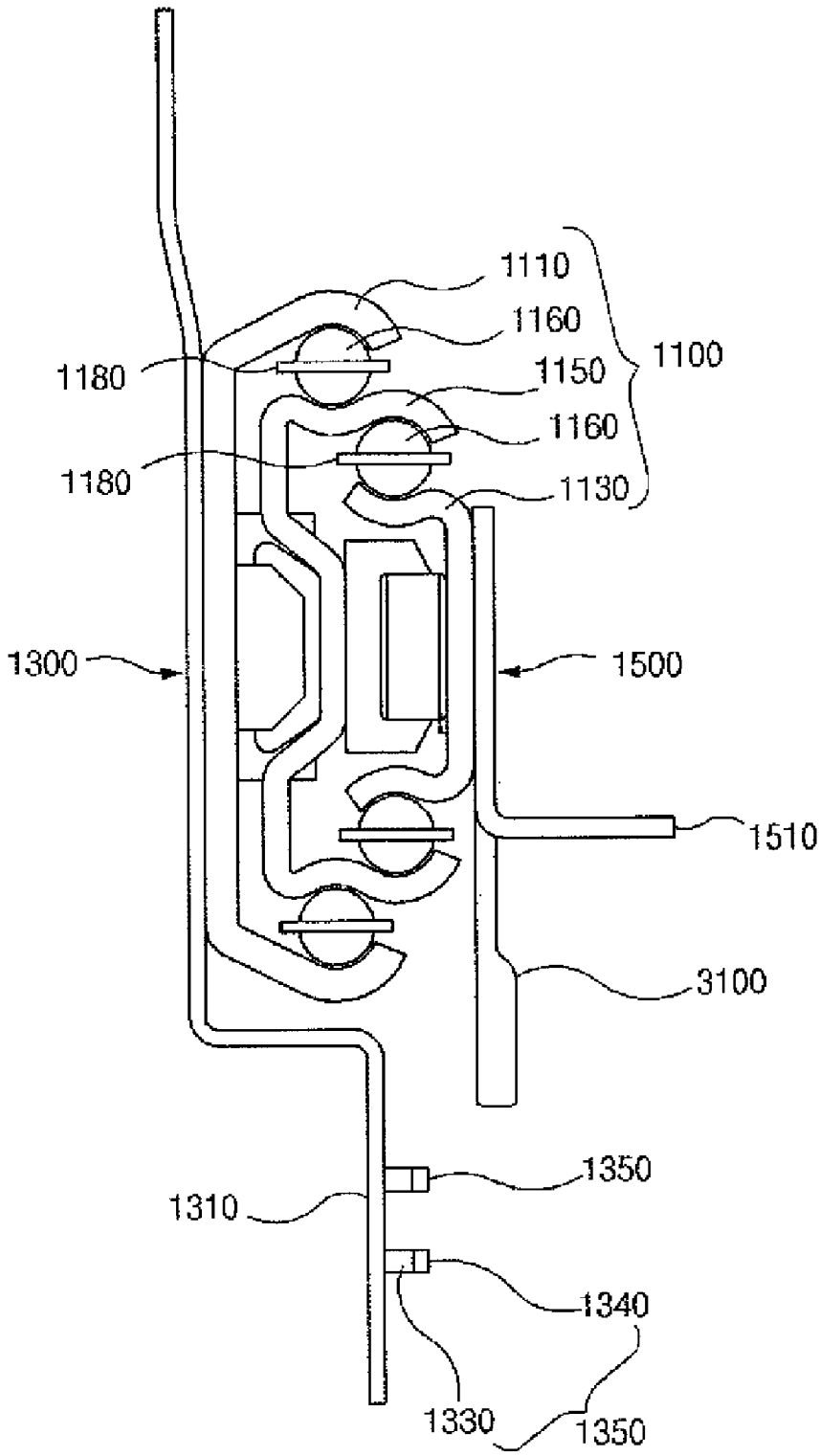

[FIG. 20]
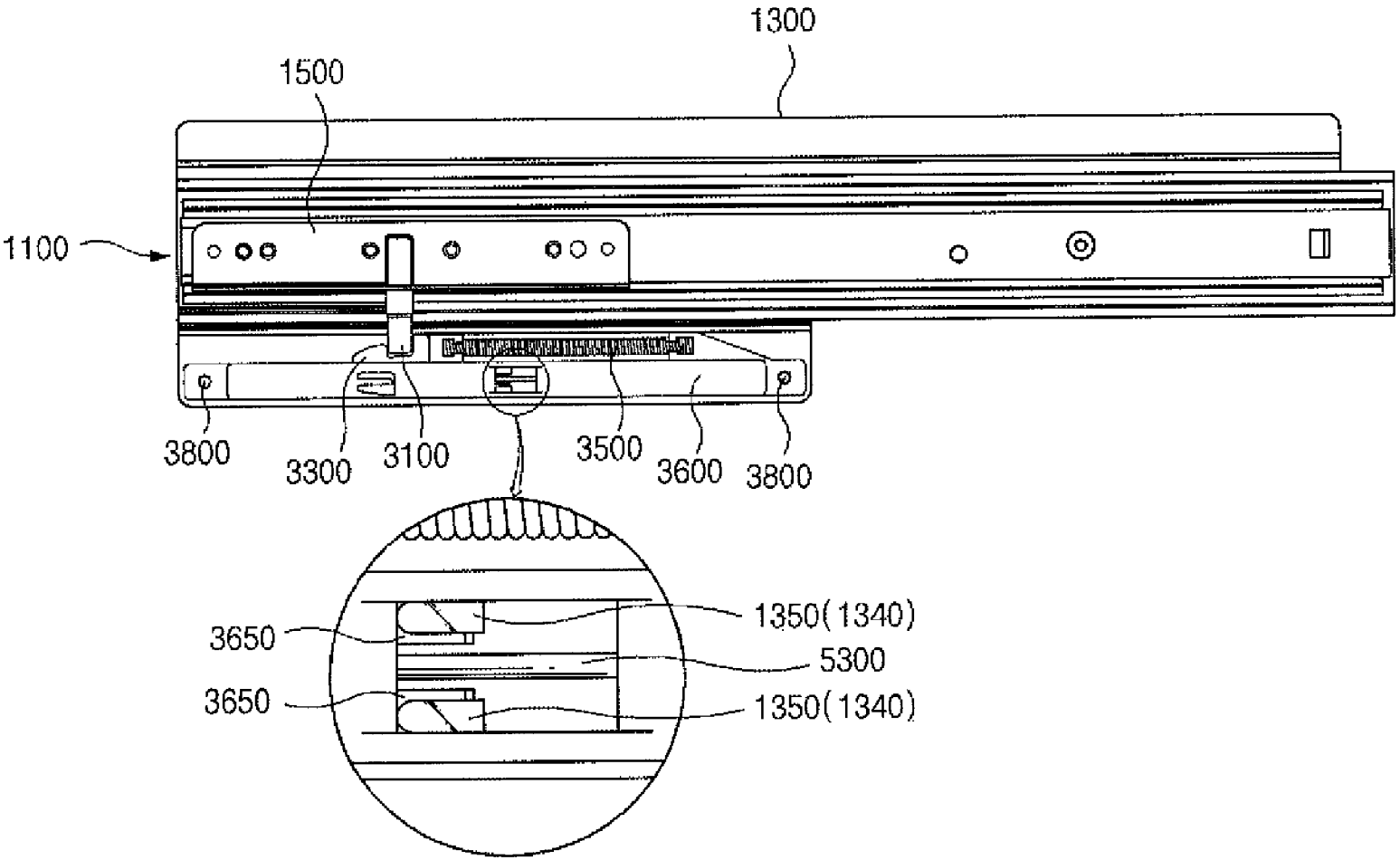

[FIG. 21]
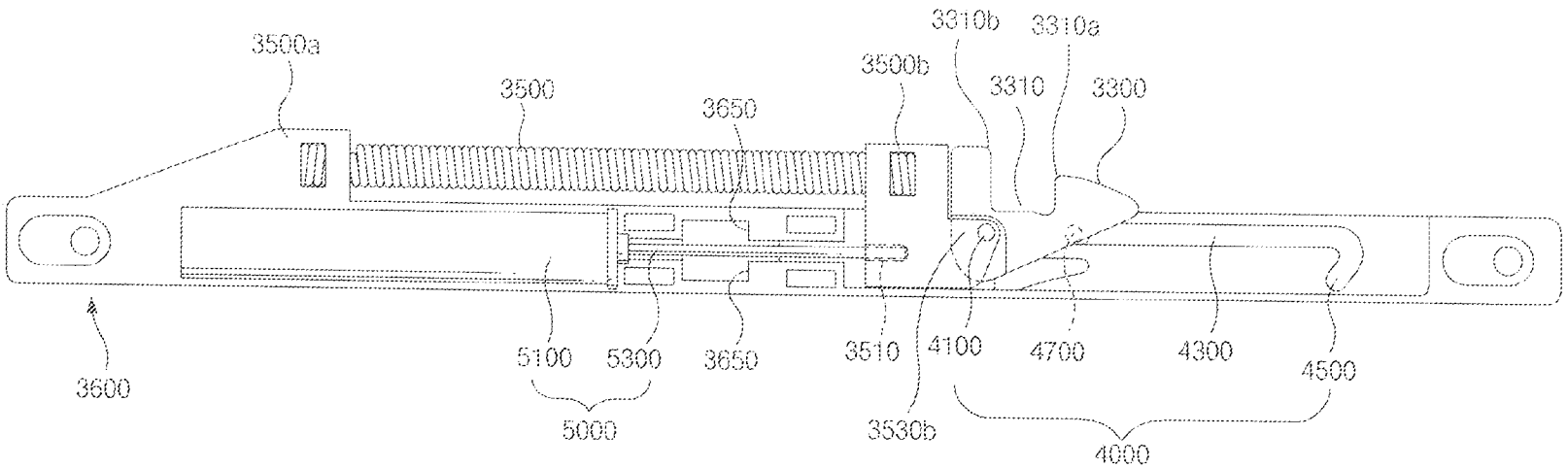

[FIG. 22]
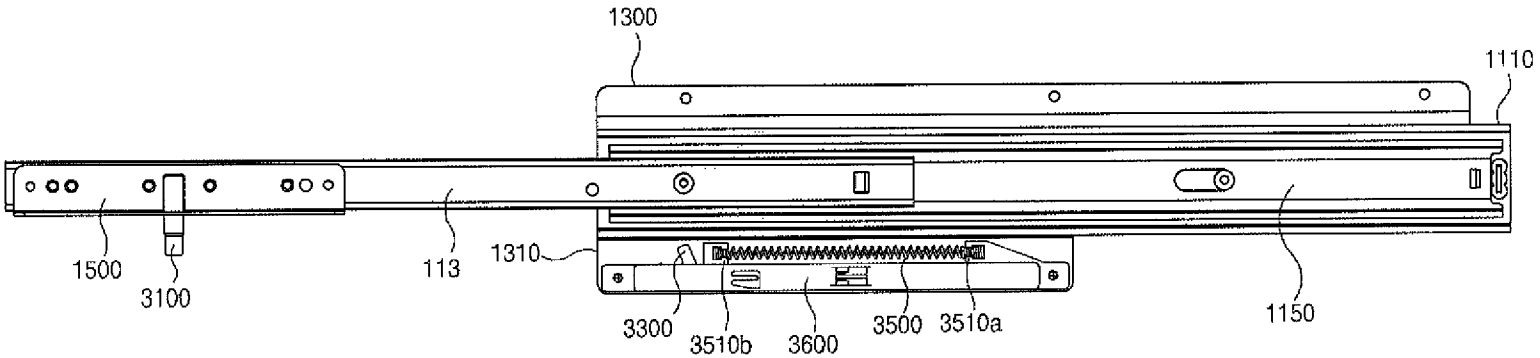

[FIG. 23]
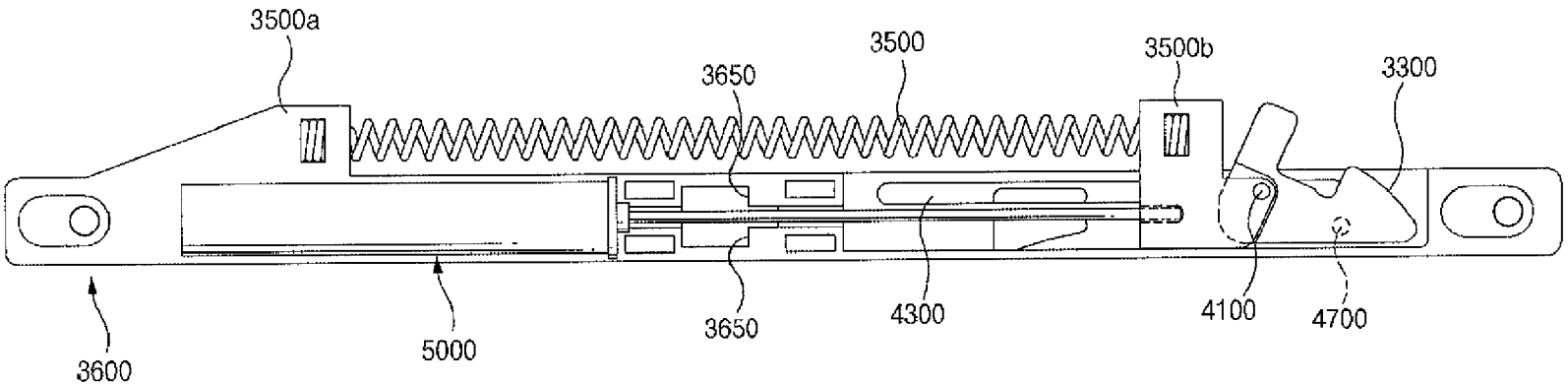

[FIG. 24]
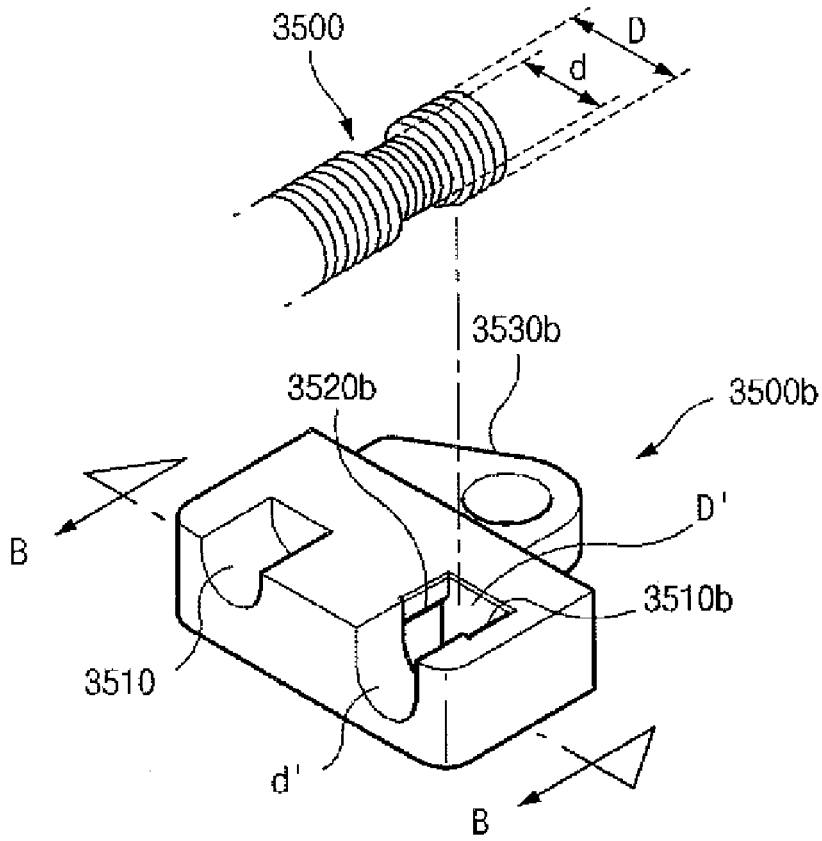
[FIG. 25]
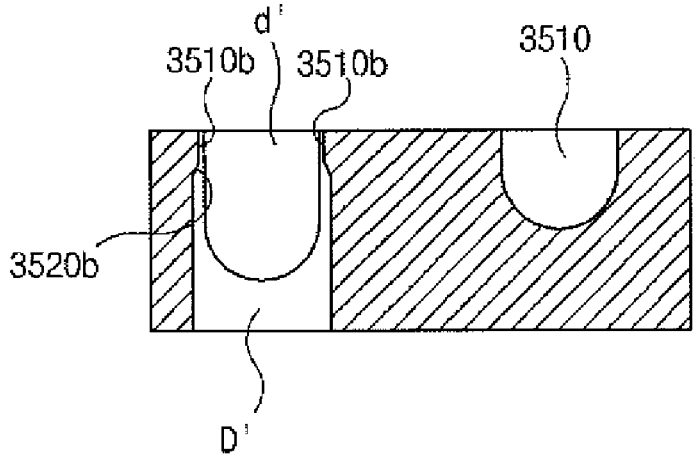

[FIG. 26]
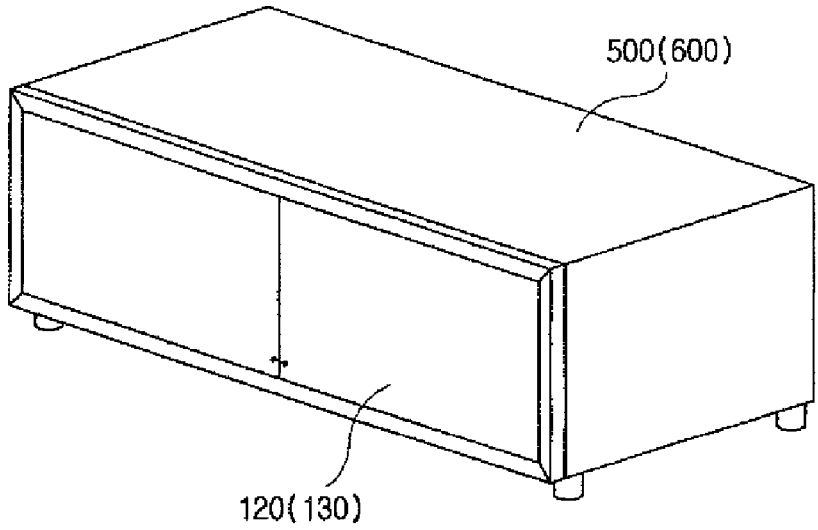
[FIG. 27]
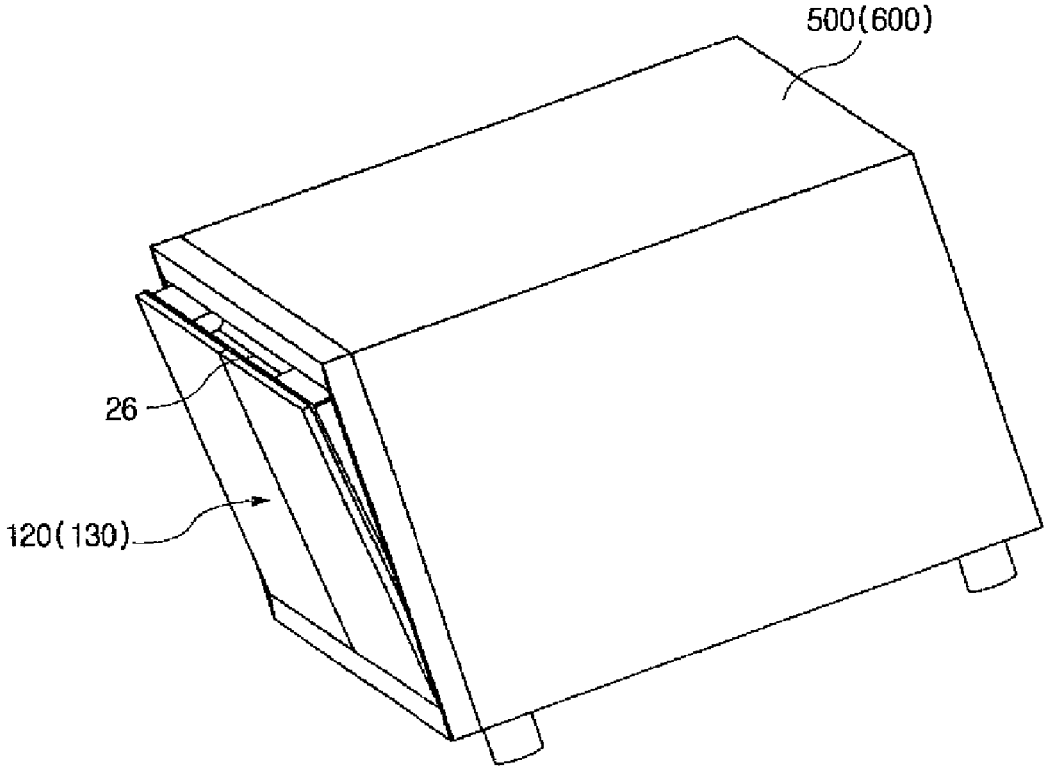

[FIG. 28]
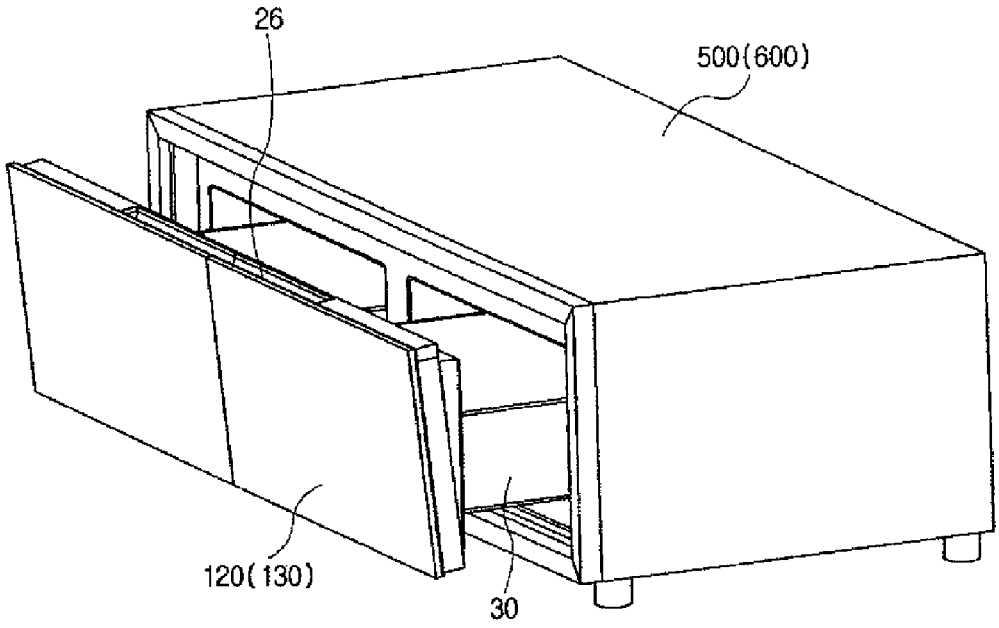
[FIG. 29]
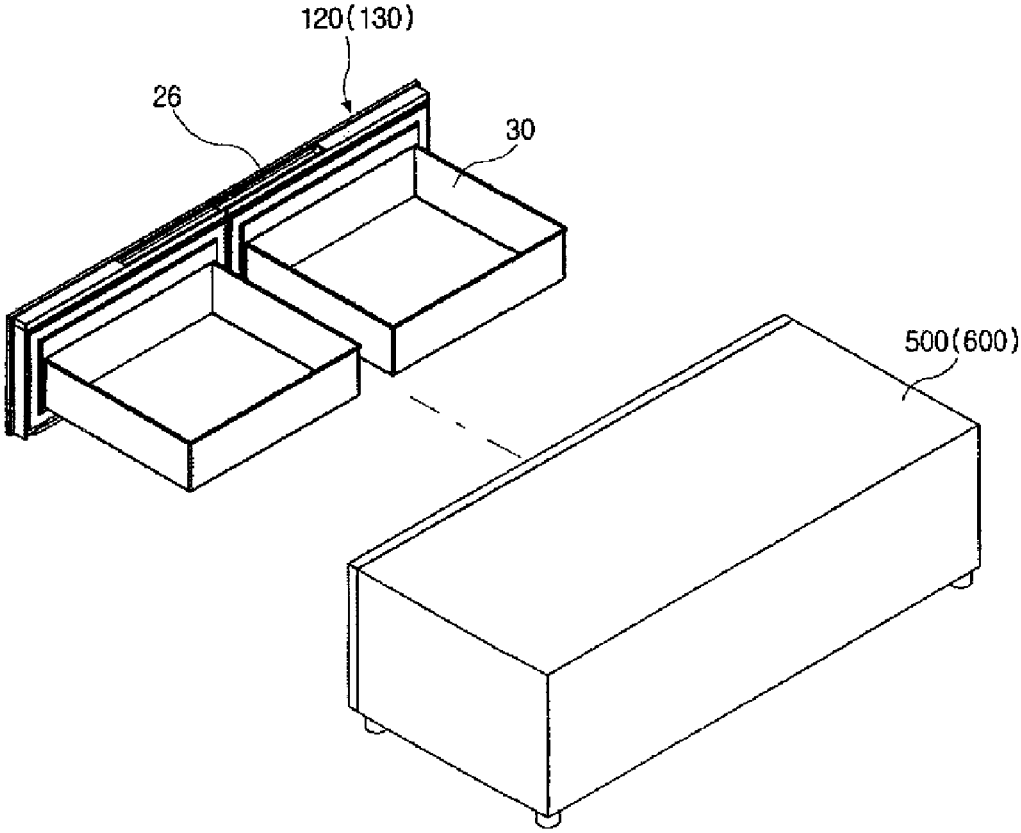

[FIG. 30]
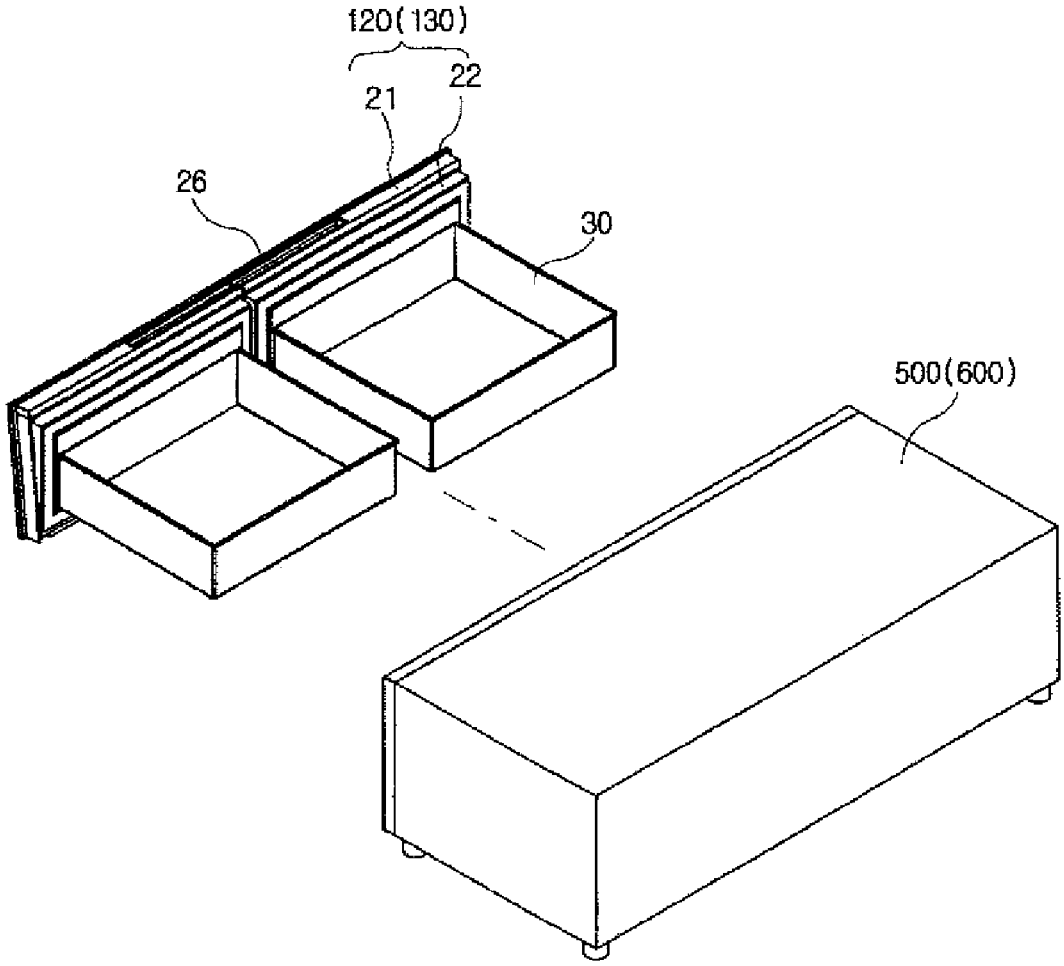

[FIG. 31]
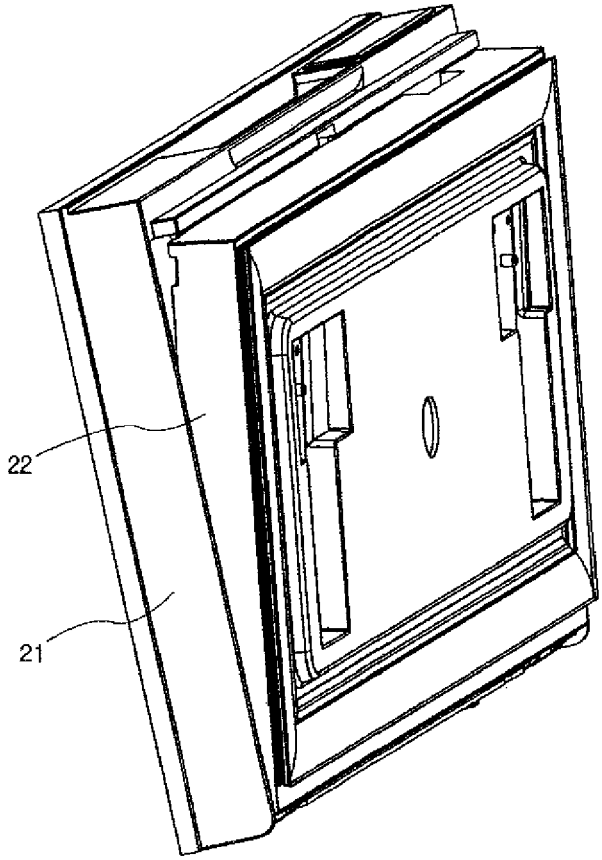
[FIG. 32]
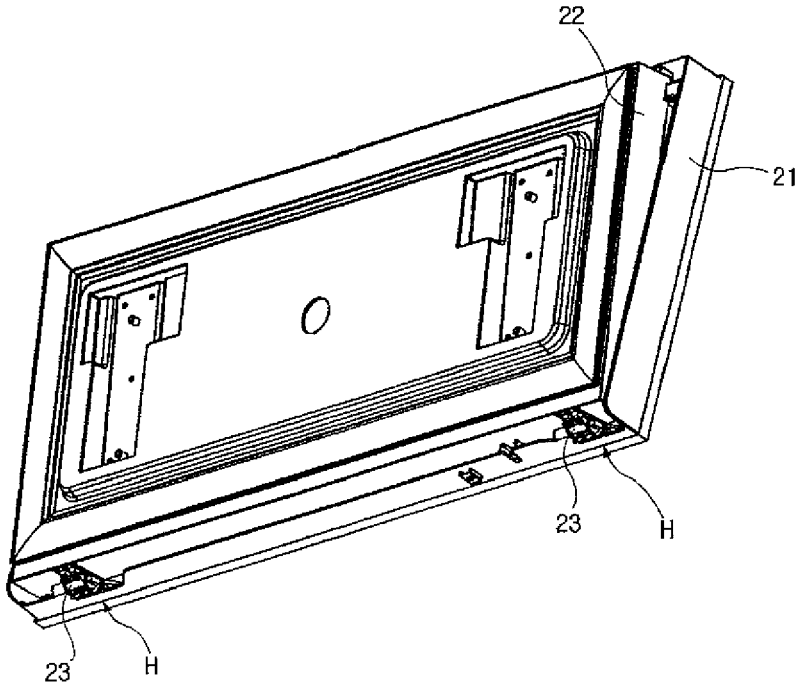

[FIG. 33]
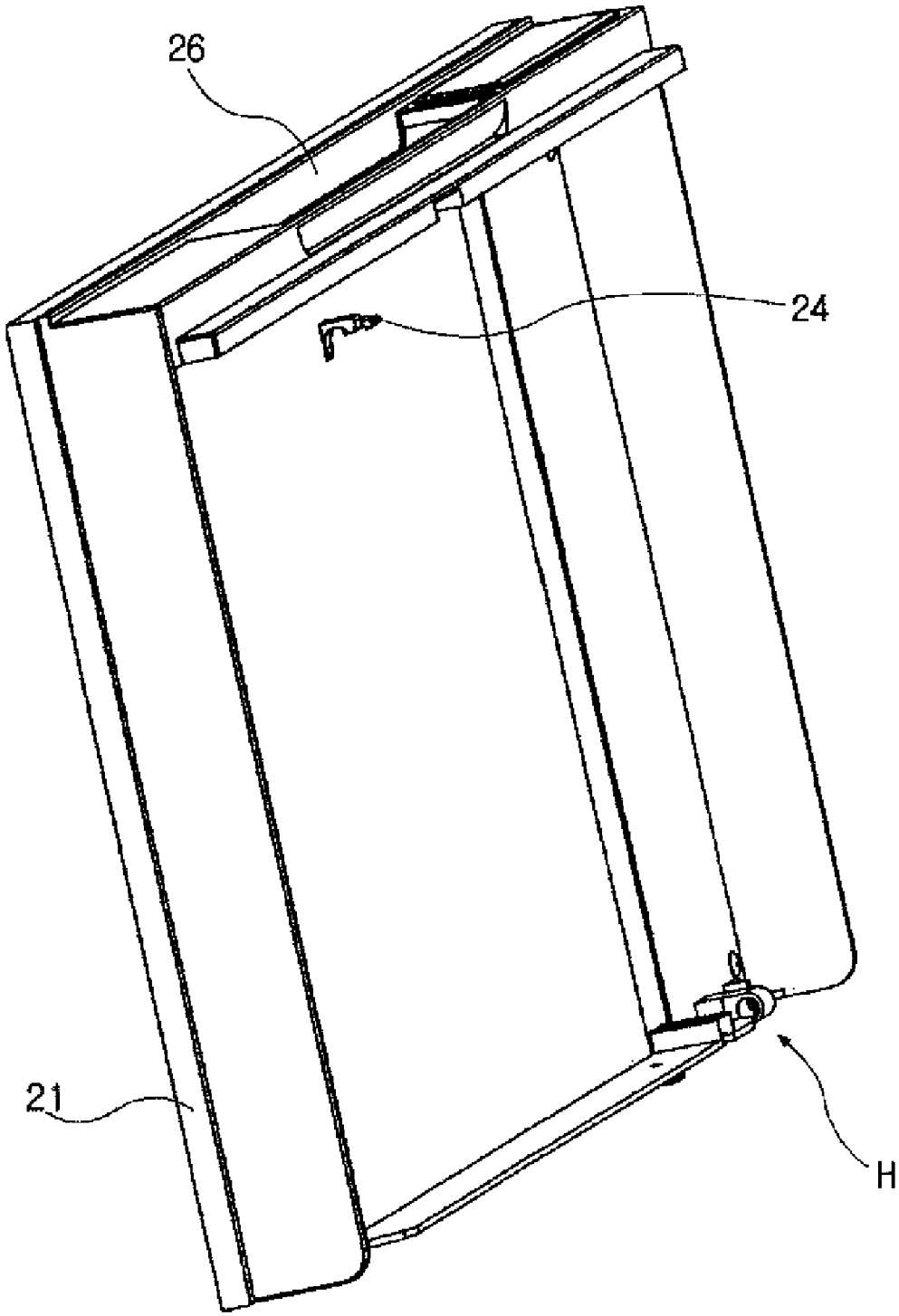

[FIG. 34]
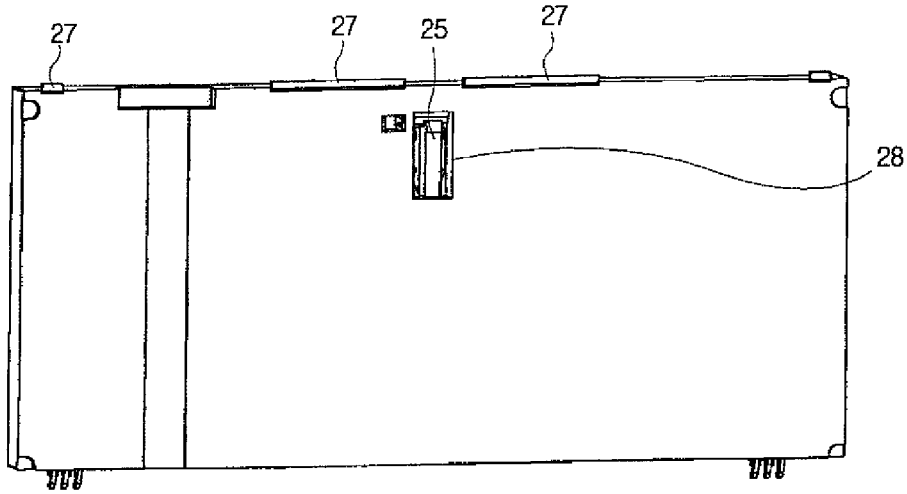
[FIG. 35]
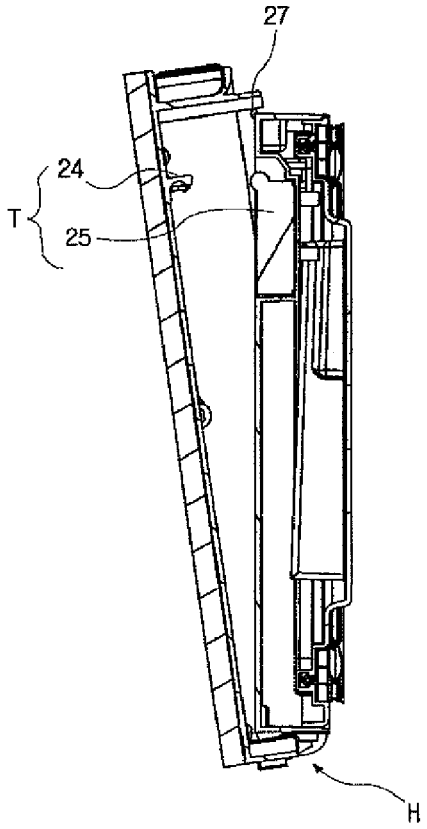

[FIG. 36]
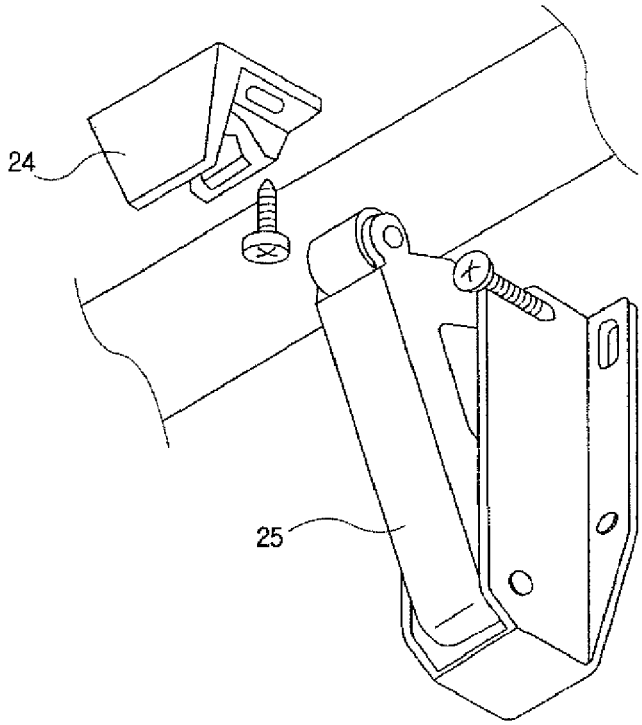
[FIG. 37]
PRIOR ART
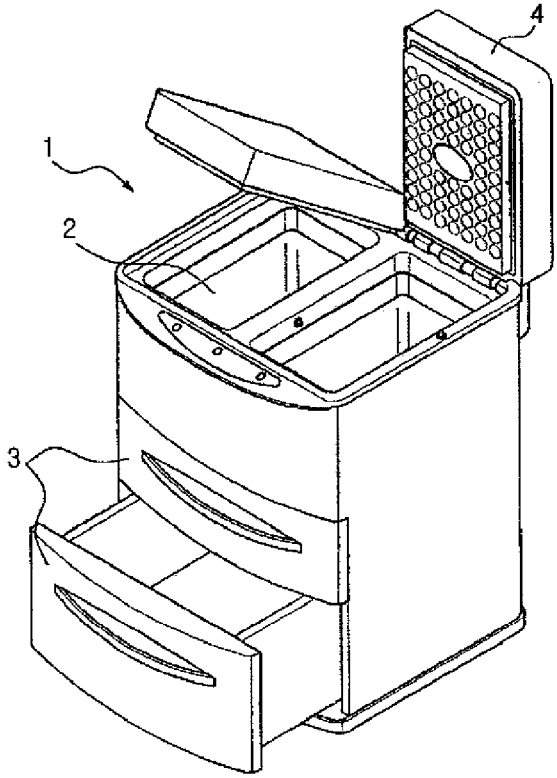

FOOD REFRIGERATOR

CROSS REFERENCE TO RELATED ART

This application claims the benefit of Korean Patent Application Nos. 10-2006-0080812 filed Aug. 24, 2006, 10-2006-0080760 filed Aug. 24, 2006, 10-2006-0080764 filed Aug. 24, 2006, and 10-2006-0099768 filed Oct. 13, 2006, the contents of each of which are incorporated herein by reference.

BACKGROUND OF THE INVENTION

1. Field of the Invention

The present invention relates to a food refrigerator including a refrigerator compartment for storing therein kimchi, fruit, vegetables, greens, drinking water, wine, beer, etc. (hereinbelow, referred to simply as "food"), and an accessory storage compartment for storing therein a variety of accessories related to the use of the food stored in the refrigerator compartment.

2. Description of the Related Art

Generally, as an example of conventional kimchi refrigerators, reference can be made to "A Kimchi Refrigerator" disclosed in Patent Document 1. As shown in FIG. 37, the conventional kimchi refrigerator 1 has upper and lower storage compartments 2 and 3, having respective spaces for storing a variety of foods therein, defined in the upper and lower parts thereof The lower storage compartment 3, defined in the lower part of the kimchi refrigerator 1, has a drawer-type opening/closing structure such that a user can open or close the lower storage compartment 3 by horizontally pulling the drawer-type compartment forwards or pushing the compartment backwards. Meanwhile, the upper storage compartment 2, defined in the upper part of the kimchi refrigerator 1, has a door-type opening/closing structure having a door 4, which is opened upwards or closed downwards by a user to open or close the compartment 2.

However, although food, such as kimchi, vegetables, fruit, wine, beer, etc., are stored in the kimchi refrigerator, a variety of accessories, such as corkscrews, bottle openers, kimchi tongs, scissors, knives, bags, etc., related to the use of the food, is not stored in the kimchi refrigerator, but must be stored in another place, such as a multipurpose room in a kitchen, so that users must often make the effort to find the accessories, and may store the accessories in unspecific places after using them, thus easily losing them.

SUMMARY OF THE INVENTION

Accordingly, the present invention has been made keeping in mind the above problems occurring in the related art, and provides a food refrigerator, which stores therein accessories related to the use of food, such as kimchi, vegetables, fruit, wine, beer, etc., stored in the food refrigerator.

In an aspect, the present invention provides a food refrigerator, which includes a refrigerator compartment and an accessory storage compartment defined in the upper surface of the refrigerator compartment.

According to the above-mentioned construction, users can conveniently store and use the accessories related to the use of food, such as kimchi, vegetables, fruit, wine, beer, etc., stored in the refrigerator compartment.

The food refrigerator may include a first refrigerator unit having a drawer-type storage compartment in the space below the refrigerator compartment, and a second refrigerator unit, having both a door-type storage compartment in an upper part thereof and a drawer-type storage compartment in a lower part thereof and placed beside the first refrigerator unit.

A bracket may be placed between the first refrigerator unit and the second refrigerator unit such that the bracket extends from the front to the back of the refrigerator units. In the above state, the front end of the bracket is mounted to the first refrigerator unit, while the rear end is mounted to the second refrigerator unit, so that the first and second refrigerator units, arranged horizontally, can be easily coupled to each other by the bracket.

The bracket is provided with a first locking hole in the front end thereof. Further, a second locking hole is longitudinally formed along the rear end of the bracket such that it extends in the direction from the front to the back of the refrigerator units. Thus, the bracket can couple the two refrigerator units to each other such that the interval between the two refrigerator units is adjustable.

The refrigerator units may include a first refrigerator unit, having a machine room, and a second refrigerator unit, placed adjacent to the first refrigerator unit. A machine room bracket, provided with a locking part on an edge thereof through bending, may be installed in the machine room. The locking part of the machine room bracket is connected to the second refrigerator unit, thus stably coupling the two refrigerator units to each other, in addition to holding machines in the machine room.

The machine room bracket is provided with a plurality of locking parts such that the locking parts are oriented in several directions, so that the second refrigerator unit may be placed at a desired location relative to the first refrigerator unit.

Further, the food refrigerator may include: a sliding rail unit, having a fixed rail unit, which is mounted to the inner casing of each of the drawer-type storage compartments, and a movable rail unit, movably mounted to the fixed rail unit and operated in conjunction with a drawer-type door of the drawer-type storage compartment; and a locking/unlocking unit for locking and unlocking the movable rail unit in forward and rearward directions. In the above state, the locking/unlocking unit can prevent the drawer-type door from being undesirably opened.

The locking/unlocking unit may include a protrusion, which is operated in conjunction with the movable rail unit; a locking lever having a locking slot for locking the protrusion when the protrusion moves rearwards; an elastic member for elastically biasing the locking lever rearwards; and an unlocked state retaining unit for retaining the unlocked state of the protrusion by rotating the locking lever when the protrusion moves forwards. Thus, the protrusion, which is locked to the locking lever, is elastically pulled rearwards by the elastic member, so that the drawer-type doors can be automatically closed.

Further, the unlocked state retaining unit may include a housing having a fixed bracket unit for supporting the first end of the elastic member; a movable bracket unit holding the second end of the elastic member and being movable forwards and rearwards; a guide groove longitudinally formed along the housing; a stop groove formed on the front end of the guide groove such that the stop groove is inclined rearwards; a hinge shaft provided on the locking lever and rotatably coupled to the movable bracket unit; and a stop protrusion provided on the locking lever such that it can slide along both the guide groove and the stop groove. Thus, when the drawer-type door is opened, the locking lever is locked to the stop protrusion, so that it is easy to close the drawer-type door.

Further, the elastic member may be a coil spring, in which the diameter of a part (small diameter part) near each end of the spring is less than that of a remaining part (large diameter part) of the end. Further, each of the fixed bracket unit and the movable bracket unit may include a small diameter groove, which seats therein the small diameter part of the spring, and a large diameter groove, which communicates with the small diameter groove and seats therein the large diameter part of the spring. Thus, the elastic member can be easily assembled with the fixed and movable bracket units and is prevented from being undesirably removed forwards or rearwards.

Further, the large diameter groove may be provided with upper stoppers for holding the upper portion of the large diameter part of the spring, thus preventing the large diameter part from being undesirably removed upwards from the large diameter groove.

Further, the sliding rail unit may be provided with a mounting bracket, which holds the fixed rail unit and is mounted to the inner casing of each of the drawer-type storage compartments. The mounting bracket may have a mounting plate, which is mounted to the housing. The mounting plate may include a locking protrusion, which is formed by cutting a cantilever strap from the mounting plate and by bending the cantilever strap into an L shape, while the housing may be provided with a locking piece that engages with the locking protrusion. Thus, the housing can be quickly and stably assembled with the mounting plate in the state in which the housing is temporarily assembled with the mounting plate, so that work efficiency during an assembling process is improved.

Further, the present invention may have a damper for reducing the rearward moving speed of the locking lever while gradually attenuating the restoring force of the elastic member. Thus, when the drawer-type doors are closed, the doors can be prevented from unexpected collision with the casing of the refrigerator units.

Further, the movable rail unit may be provided with a movable bracket, on which the protrusion is mounted. When the movable bracket is provided with a support plate for supporting the drawer-type door, it is possible to easily mount the protrusion to a conventional movable rail unit and to securely support the drawer-type doors.

Further, the door of each of the drawer-type storage compartments may have a double door structure including a tilting door unit, placed at a front location and tilted forwards around a hinge part provided on the lower end thereof, and a support door unit placed at a rear location and covered with the tilting door unit. Further, a tilting unit may be provided between the tilting door unit and the support door unit for executing a tilting motion, so that, when the upper portion of the door is pushed with a hand, part of the upper portion of the door is tilted forwards by the operation of the tilting unit, thus exposing a previously hidden handle grip outside.

The hinge part may include a hinge for coupling the tilting door unit and the support door unit to each other, and the tilting unit may include a one-touch latch, provided on the support door unit, and a locker provided on the tilting door unit that can engage with the latch.

The support door unit may be provided on the upper end thereof with a plurality of stoppers so as to prevent the upper end of the tilting door unit from being spaced excessively far apart from the upper end of the support door unit when the tilting door unit is tilted forwards relative to the support door unit.

BRIEF DESCRIPTION OF THE DRAWINGS

The above and other objects, features and other advantages of the present invention will be more clearly understood from the following detailed description when taken in conjunction with the accompanying drawings, in which:

FIG. 1 is a perspective view of a food refrigerator according to an embodiment of the present invention;

FIG. 2 is a perspective view of the food refrigerator according to the embodiment of the present invention;

FIG. 3 is a perspective view of a front connection bracket according to an embodiment of the present invention;

FIG. 4 is an exploded rear perspective view of the food refrigerator according to the embodiment of the present invention;

FIG. 5 is an exploded front perspective view of the food refrigerator according to the embodiment of the present invention;

FIG. 6 is an enlarged view illustrating the state in which the front connection bracket is installed;

FIG. 7 is an enlarged view illustrating the state in which a rear connection bracket is installed;

FIG. 8 is an enlarged view illustrating the state in which a machine room bracket is installed;

FIG. 9 is a perspective view of a support;

FIG. 10 is a perspective view illustrating legs and connectors;

FIG. 11 is a perspective view illustrating a frame assembly and connectors;

FIG. 12 is an enlarged view illustrating the state in which a locking part is installed;

FIG. 13 is a perspective view of the food refrigerator;

FIG. 14 is a perspective view of a rack unit;

FIG. 15 is a bottom perspective view of the rack unit;

FIG. 16 is a perspective view of a guide unit;

FIG. 17 is a view illustrating the state in which the guide unit is installed;

FIG. 18 is a perspective view illustrating a rail device for a drawer-type storage compartment according to an embodiment of the present invention;

FIG. 19 is a front view of the rail device of FIG. 18, from which a housing is omitted;

FIG. 20 is a side view of the rail device of FIG. 18 in a locked state;

FIG. 21 is a rear view illustrating the state of the housing of FIG. 20;

FIG. 22 is a side view of FIG. 18 in an unlocked state;

FIG. 23 is a rear view of the housing of FIG. 22;

FIG. 24 is a perspective view illustrating both a movable bracket unit and an elastic member;

FIG. 25 is a sectional view taken along line B-B of FIG. 24;

FIG. 26 is a perspective view illustrating a product having a drawer-type door according to the present invention when the drawer-type door is in a closed state;

FIG. 27 is a perspective view illustrating the product having the drawer-type door according to the present invention when the upper part of the drawer-type door is opened through a tilting motion and a handle grip of the door is exposed outside;

FIG. 28 is a perspective view illustrating the product having the drawer-type door according to the present invention when the drawer-type door is in a completely opened state;

FIG. 29 is an exploded perspective view illustrating the product having the drawer-type door according to the present invention when the drawer-type door is separated from the body of the product to show the state before the tilting motion;

FIG. 30 is an exploded perspective view illustrating the product having the drawer-type door according to the present invention when the drawer-type door is separated from the body of the product to show the state after the tilting motion;

FIG. 31 and FIG. 32 are perspective views illustrating the construction of the drawer-type door according to the present invention;

FIG. 33 is a perspective view illustrating a tilting door unit of the drawer-type door according to the present invention;

FIG. 34 is a front view illustrating a support door unit of the drawer-type door according to the present invention;

FIG. 35 is a sectional view illustrating a state of engagement between the tilting door unit and the support door unit of the drawer-type door according to the present invention;

FIG. 36 is a perspective view illustrating an embodiment of both a latch and a locker used in the tilting unit of the drawer-type door according to the present invention; and FIG. 37 is a perspective view illustrating a conventional kimchi refrigerator.

DETAILED DESCRIPTION OF THE INVENTION

Reference will now be made in greater detail to embodiments of the present invention, an example of which is illustrated in the accompanying drawings.

FIG. 1 is a perspective view of a food refrigerator according to an embodiment of the present invention. FIG. 2 is a perspective view of the food refrigerator according to the embodiment of the present invention. FIG. 3 is a perspective view of a front connection bracket according to an embodiment of the present invention. FIG. 4 is an exploded rear perspective view of the food refrigerator according to the embodiment of the present invention. FIG. 5 is an exploded front perspective view of the food refrigerator according to the embodiment of the present invention. FIG. 5 is an enlarged view illustrating the state in which the front connection bracket is installed. FIG. 7 is an enlarged view illustrating the state in which a rear connection bracket is installed. FIG. 8 is an enlarged view illustrating the state in which a machine room bracket is installed. FIG. 9 is a perspective view of a support. FIG. 10 is a perspective view illustrating legs and connectors. FIG. 11 is a perspective view illustrating a frame assembly and connectors. FIG. 12 is an enlarged view illustrating the state in which a locking part is installed. FIG. 13 is a perspective view of the food refrigerator. FIG. 14 is a perspective view of a rack unit. FIG. 15 is a bottom perspective view of the rack unit. FIG. 16 is a perspective view of a guide unit. FIG. 17 is a view illustrating the state in which the guide unit is installed.

As shown in FIG. 1 through FIG. 17, the hybrid food refrigerator according to the present invention is provided with multipurpose compartments for storing therein kimchi, vegetables, fruit, wine, etc., and includes a plurality of separate refrigerator units and a plurality of brackets for coupling the refrigerator units to each other.

The refrigerator units include a first refrigerator unit 100*a*, having a machine room 160, and a second refrigerator unit 100*b* which is placed beside the first refrigerator unit 100*a* and forms a pair of refrigerator units in cooperation with the first refrigerator unit 100*a*. As shown in FIG. 2, the first refrigerator unit 100*a* includes a left door-type storage compartment 100, which is defined in the upper part of the first refrigerator unit 100*a* and is opened and closed by an openable door, and a left drawer-type storage compartment 500, which is defined in the lower part of the unit 100*a* and is opened and closed by a drawer-type door. Further, the machine room 160, having the form of an open recess, is defined in the rear surface of the left drawer-type storage compartment 500 of the first refrigerator unit 100*a*, and holds machines, such as a compressor, therein. The second refrigerator unit 100*b* includes a right door-type storage compartment 190, which is defined in the upper part of the second refrigerator unit 100*b* and is opened and closed by an openable door, and a right drawer-type storage compartment 600, which is defined in the lower part of the unit 100*b* and is opened and closed by a drawer-type door. The left door-type storage compartment 100 is configured as an upward openable structure, which is opened or closed by a left upper door 150 rotatably mounted to the upper end of the compartment 100. The left door-type storage compartment 100 may store therein kimchi, vegetables, fruit, etc. However, the left door-type storage compartment 100 is preferably used as a kimchi storage compartment for storing kimchi. In the left door-type storage compartment 100, the inner casing for storing kimchi therein is surrounded by an evaporator and a heater (not shown). Further, a deodorizer 103 is installed at the center of the inner surface of the left upper door 150 and deodorizes the contents stored in the left door-type storage compartment 100. A lamp 104 is installed near the deodorizer 103 and is turned on when the left upper door 150 is opened. Further, a control panel 102 is provided on the upper part of the front surface of the left door-type storage compartment 100 for controlling the operation of the left door-type storage compartment 100.

Further, a wine storage compartment 170 is defined in the right door-type storage compartment 190, and stores wine bottles B therein. Here, an evaporator and a heater (not shown) are installed in the rear part of the wine storage compartment 170. The right door-type storage compartment 190 is provided with upper and front doors 110 and 140 on the upper and front parts thereof. Thus, a user may store wine bottles in the wine storage compartment 170 after opening the front door 110. Further, an accessory storage compartment 180 is provided on the upper surface of the right door-type storage compartment 190, which is a compartment for storing wine therein. The accessory storage compartment 180 is opened or closed by the right upper door 140, and includes therein an accessory storage tray 105 for storing a variety of accessories, such as a corkscrew. Further, a control panel 101 is provided on the lower surface of the front part of the wine storage compartment 170 for controlling the operation of the wine storage compartment 170.

Further, the left drawer-type storage compartment 500 stores therein kimchi, fruit, vegetables, etc., and is provided with a drawer-type door 130. Thus, the drawer-type door 130 of the left drawer-type storage compartment 500 is sliding forwards and backwards in a manner similar to a typical drawer, thus being opened or closed. Here, an evaporator and a heater (not shown) are provided in the rear part of the left drawer-type storage compartment 500.

The right drawer-type storage compartment 600 is used as a compartment for storing wine bottles therein in the same manner as that described for the wine storage compartment 170. In the same manner as that described for the left drawer-type storage compartment 500, the right drawer-type storage compartment 600 is provided with a drawer-type door 120, which is sliding forwards and backwards so as to be opened or closed. Further, two wine racks 122 are installed in the right drawer-type storage compartment 600, such that the racks 122 form a two-level structure and support a plurality of wine bottles thereon. The upper wine rack 122 is configured to be inclined at an angle of about 45 degrees relative to the lower wine rack 122, so that a user can easily store wine bottles on the wine racks and easily take wine bottles out of the racks. In the above state, an evaporator and a heater (not shown) are installed in the rear part of the right drawer-type storage compartment 600.

The hybrid food refrigerator, having the above-mentioned construction according to the present invention, is provided with a plurality of multipurpose compartments for storing kimchi, vegetables, fruit, wine, etc. therein, thus functioning as a food refrigerator and a wine cellar, so that it is not required for users to purchase separate wine cellars for storing wine, and thus the users save money. Further, the door-type storage compartments and the drawer-type storage compartments, for storing therein kimchi, vegetables, fruit, wine, etc. are optimally arranged in the food refrigerator, so that users can easily use the storage compartments. Therefore, the marketability of the product is increased.

The brackets include a front connection bracket 410, which connects the front part of the first refrigerator unit 100*a* to the front part of the second refrigerator unit 100*b*, a rear connection bracket 420, which connects the rear part of the first refrigerator unit 100*a* to the rear part of the second refrigerator unit 100*b*, and a machine room bracket 430, which is installed in the machine room 160.

The front connection bracket 410 is installed in the front part of the junction between the first refrigerator unit 100*a* and the second refrigerator unit 100*b*. The front end of the front connection bracket 410 is connected to the first refrigerator unit 100*a*, while the rear end of the bracket 410 is connected to the second refrigerator unit 100*b*. The front connection bracket 410 includes a rear part 416, which is connected to a side surface of the second refrigerator unit 100*b*, a front part 414, which is formed by bending the rear part 416 an amount corresponding to the thickness of a cover part 415 and has a first locking hole 418 so as to be connected to a side surface of the first refrigerator unit 100*a*, and a bent part 411, which is formed by bending the front part 414, placed on the front surface of the first refrigerator unit 100*a*. The rear part 416 and the cover part 415 have a total length corresponding to the height of the second refrigerator unit 100*b*. The front part 414 is shorter than the rear part 416 such that the front part 414 reaches only a predetermined upper part of the left drawer-type storage compartment 500. Thus, when the left drawer-type door 130 is opened or closed, the front part 414 does not interfere with the drawer-type door 130 and does not form any gap between it and the drawer-type door 130. A second locking hole 419 is forwards and backwards formed in the rear part 416, thus easily connecting the horizontally arranged refrigerator units to each other and defining a desired gap between the two refrigerator units. Further, the cover part 415 closes the gap defined between the first refrigerator unit 100*a* and the second refrigerator unit 100*b*.

A left upper door 150 is provided on the upper part of the first refrigerator unit 100*a*, thus closing the storage compartment of the first refrigerator unit 100*a*. Meanwhile, a front door 110 is provided on the front part of the second refrigerator unit 100*b*, thus closing the storage compartment of the second refrigerator unit 100*b*. Here, the first refrigerator unit 100*a* is preferably configured to protrude from the second refrigerator unit 100*b* an amount corresponding to the thickness of the front door 110, so that, when the front door 110 is closed, the front door 110 does not protrude from the front surface of the first refrigerator unit 100*a*. In other words, the portion in the first refrigerator unit 100*a*, to which the front connection bracket 410 is mounted, is offset from the portion in the second refrigerator unit 100*b*, to which the front connection bracket 410 is mounted.

Thus, the rear part of the front connection bracket 410 is connected to the side surface of the second refrigerator unit 100*b* and, thereafter, the front part of the front connection bracket 410 is connected to a predetermined side portion of the first refrigerator unit 100*a*, which faces the front door 110. Thus, the first refrigerator unit 100*a* is securely connected to the second refrigerator unit 100*b*.

The rear connection bracket 420 includes a vertical part and a mounting part, which is formed by bending the vertical part and has a locking hole for receiving a locking bolt. The rear connection bracket 420 is horizontally placed on the rear surfaces of both the first refrigerator unit 100*a* and the second refrigerator unit 100*b*. The first end of the mounting part is bolted to the rear surface of the first refrigerator unit 100*a*, while the second end of the mounting part is bolted to the rear surface of the second refrigerator unit 100*b*. Further, to prevent the rear connection bracket 420 from being exposed outside, the rear connection bracket 420 is installed at a predetermined portion, to which a frame assembly of a support 300 is mounted. In other words, the rear connection bracket 420 is preferably installed at a location between the frame assembly and the refrigerator units.

The machine room bracket 430 has a specific polygonal shape, similar to a rectangular shape, corresponding to the cross-section of the machine room 160, and is placed in the machine room 160 and oriented in the direction from the back to the front of the refrigerator unit 100*a*. The machine room bracket 430 is provided with a pipe leading hole through which a pipe of the second refrigerator unit 100*b* passes to be connected to machines, such as a compressor, installed in the machine room 160. The four side edges of the machine room bracket 430 are bent to form respective locking parts 431. That is, the locking parts 431 are oriented in four directions. The rear locking part 431 is bent toward the second refrigerator unit 100*b* and is bolted to the rear surface of the second refrigerator unit 100*b*. Meanwhile, the front, upper and lower locking parts 431 are locked to the inner surface of the first refrigerator unit 100*a*, so that the machine room bracket 430 can be locked to the machine room 160.

When the second refrigerator unit 100*b* is placed beside the opposite side surface of the first refrigerator unit 100*a*, unlike the above-mentioned arrangement, the first refrigerator unit 100*a* and the second refrigerator unit 100*b* can be connected to each other using a locking part 431 placed near the second refrigerator unit 100*b*.

Further, the shapes of the brackets may be variously changed in accordance with the arrangement of the refrigerator units.

As described above, the present invention includes a plurality of brackets for connecting the separately produced refrigerator units to each other, so that a user may easily change the arrangement of the refrigerator units as desired, and may easily assemble the refrigerator units into one product. Thus, the utility of the food refrigerator is increased.

The support 300 includes at least three legs 320 and a plurality of locking parts 340, which are connected to the legs 320 at first ends thereof and to the side surfaces of the refrigerator units at second ends thereof. The present invention includes four legs 320 having a polygonal cross-section, similar to a triangular cross-section, with insert holes formed in end surfaces of each leg. The lower ends of the legs 320 are located at positions lower than the lower ends of the refrigerator units, thus spacing the refrigerator units above the ground surface. The locking parts 340, each having a panel shape, are integrally formed along the side surfaces of the respective legs 320. A plurality of longitudinal holes 342 is formed along the free edge of each locking part 340, and receives respective locking bolts for locking the locking parts 340 to the refrigerator units. Due to the longitudinal holes 342, the supports 300 can be easily mounted to electronic appliances having different sizes. Further, a plurality of longitudinal protrusions 341 may be longitudinally formed on the front surface of each of the locking parts 340, thus increasing the strength of the locking parts 340. The longitudinal protrusions 341, formed on the front surface of the each locking part 340, are not formed in the area having the longitudinal holes 342. On the rear surface of each of the locking parts 340, longitudinal protrusions are longitudinally formed at locations around the opposite sides of the longitudinal holes 342. The locking parts 340 are installed on the front and rear parts of the outer surfaces of both the first refrigerator unit 100*a* and the second refrigerator unit 100*b*. Further, a cover 350 is provided on the lower part of the outer surface of both the first refrigerator unit 100*a* and the second refrigerator unit 100*b*, such that the cover 350 covers the locking part 340*s* so as to prevent the locking parts 340 from being exposed outside, and improve the appearance of the food refrigerator.

The cover 350 is provided with locking pieces on the upper and lower parts thereof, so that the cover 350 can be easily installed on the first refrigerator unit 100*a* and the second refrigerator unit 100*b* by inserting the locking pieces into the gaps of the locking parts 340. The frame assembly is mounted to the upper ends of the legs 320, thus surrounding the outer surfaces of both the first refrigerator unit 100*a* and the second refrigerator unit 100*b*.

In the embodiment, the frame assembly is configured to surround all of the outer surfaces of both the first refrigerator unit 100*a* and the second refrigerator unit 100*b*. However, it should be understood that the frame assembly may alternatively be configured to surround part of the outer surfaces of both the first refrigerator unit 100*a* and the second refrigerator unit 100*b*.

Here, the frame assembly partitions the upper storage compartments of both the first refrigerator unit 100*a* and the second refrigerator unit 100*b* from the lower storage compartments. Both the first refrigerator unit 100*a* and the second refrigerator unit 100*b* may be provided with respective locking steps, which can be engaged with the frame assembly. Further, the frame assembly may be connected to the legs 320, thus improving the appearance of the electronic appliance and stably supporting the electronic appliance. The frame assembly comprises a plurality of frames 310. Each of the frames 310 is provided with an insert hole at each end thereof. One surface of each of the frames 310 is formed as an inclined surface The frames 310 are connected to each other using a plurality of connectors 330. Two side ends of each of the connectors 330 are provided with respective side locking protrusions 331 and 332, which are inserted into and locked to the insert holes of the frames 310. A lower locking protrusion 333 is provided on the lower end of each connector 330 and is inserted into the insert hole of each of the legs 320, so that the support 300 can be easily assembled. Each of the two side locking protrusions 331 and 332 and the one lower locking protrusion 333 is provided with a longitudinal slit. Further, each of the connectors 330 is provided with an angled vertical groove on a predetermined portion between the two side locking protrusions 331 and 332.

As described above, the support 300 improves the appearance of the electronic appliance, and securely mounts the legs 320 to the electronic appliance.

Alternatively, the present invention may comprise a frame assembly, which includes a plurality of frames, placed around the outer surface or along the sides of the electronic appliance in a circumferential direction or in a vertical direction, a plurality of connectors 330 for connecting the frames to each other, and a plurality of locking parts 340, first ends of which are connected to the frames and second ends of which are mounted to the electronic appliance. The frame assembly may function as a means for decorating the electronic appliance and improving the appearance of the electronic appliance.

The right door-type storage compartment 190 is provided therein with a rack unit 200 for supporting a plurality of wine bottles thereon. The rack unit 200 has a multi-layered structure, in which a plurality of rack units is stacked in the compartment 170. The rack unit 200 includes a guide unit 220, having a guide groove 225, and a rack 210 having a sliding part for sliding along the guide groove 225. The rack unit 200 may be made of wood. The rack 210 includes a front frame 211, which extends in the longitudinal direction from the left to the right of the compartment 170, and a plurality of latitudinal frames 213, which extend backwards from the front frame 211 at intervals to form a lattice structure. Thus, the rack 210 stably supports a plurality of wine bottles, having cylindrical shapes, on the spaced latitudinal frames 213. A stop wall 212 longitudinally extends at the rear end of the rack 210 such that the rear ends of the latitudinal frames 213 are connected to the stop wall 212. The stop wall 212 prevents the wine bottles from dropping from the rear end of the rack 210. The sliding part includes a connection part 215, which is provided on the lower surface of the rack 210 and is connected to the lower part of the rack 210, a bent engaging part 216, which is formed on the lower part of the connection part 215 and is engaged with the guide groove 225, and a bolted part 214, which is provided on an upper part of the connection part 215 and is bent in a direction opposite the bent direction of the engaging part 216. The sliding part is mounted to a latitudinal frame 213 of the rack 210.

The guide unit 220 includes a mounting part 221 and a support part 224, which protrudes from the lower end of the mounting part 221. The mounting part 221 is provided with a plurality of locking holes 222 for locking the guide unit 220 to the inner casing of the right door-type storage compartment 190 using locking bolts. A plurality of countersinks 223 is formed in the outer surface of the mounting part 221 such that they communicate with respective locking holes 222. Because the heads of the locking bolts are seated in the respective countersinks 223, the rack 210 is prevented from interfering with the heads of the locking bolts when it moves along the guide units 220. A guide groove 225 is formed in the lower portion of the rear part of the support part 224. An insert hole 226 is formed in the rear end of the support part 224, and communicates with the guide groove 225. The support part 224 is provided with a stop end 227, which engages with the engaging part 216 of the sliding part. The support part 224 is provided with an inclined surface 228, so that the thickness of the support part 224 is increased in the rearward direction. Due to the above-mentioned construction of the rack unit 200, two guide units 220 are bolted to the opposite inner side surfaces of the right door-type storage compartment 190, such that the guide units 220 extend from the front to the back. Thereafter, the rack 210 is placed on the two guide units 220 and the sliding parts of the rack 210 are inserted into the insert holes 226 of the guide units 220, so that the engagement of the rack 210 with the guide units 220 is easily accomplished. Further, when it is desired to use the right door-type storage compartment 190 for storing food instead of wine, the rack 210 is lifted up to remove the sliding parts from the insert holes 226, so that the compartment 190 can be easily used for storing food instead of wine. In the present invention, the rack unit 200 has a simple construction to allow a user to easily take the bottles out of the rack unit 200. Further, the rack 210 is configured such that it is stopped after it has been ejected a predetermined distance from the compartment 170. Thus, when the rack 210 is ejected from the compartment 170, the rack 210 is prevented from being undesirably removed from the compartment 170.

Further, the present invention may be configured such that the guide unit 220 does not have a guide groove 225, but has a locking hole and a stop end, which protrudes from the lower portion of the guide unit 220 at a location in front of the locking hole. In the above state, the sliding parts of the rack 210 are engaged with the locking holes of the guide units 220, so that the rack 210 is brought into movable engagement with the guide units 220 so as to slide forwards and backwards along the guide units 220.

In the following description, the technical term "forwards" means the direction in which a protrusion is unlocked and a drawer-type storage compartment can be opened, and the term "rearwards" means the direction in which the protrusion is locked and the drawer-type storage compartment is closed.

FIG. 18 is a perspective view illustrating a rail device of a drawer-type storage compartment according to an embodiment of the present invention. As shown in FIG. 18, the rail device 1000 according to the embodiment includes a sliding rail unit 1100 and a locking/unlocking unit 3000 for locking or unlocking the sliding rail unit 1100.

Due to the locking/unlocking unit 3000, it is not necessary to check whether or not the drawer-type storage compartments having the drawer-type doors 120 and 130 are completely closed, so that the present invention is convenient to users.

As shown in FIG. 19, the sliding rail unit 1100 includes a fixed rail unit 1110 and a movable rail unit 1130, which is movable along the fixed rail unit 1110 using a plurality of rolling balls 1160. The fixed rail unit 1110 may be directly mounted to the inner casing of the drawer-type storage compartment, or may be indirectly mounted to the inner casing of the compartment using a mounting bracket 1300, which will be described in detail later herein. Further, when an intermediate movable rail unit 1150 is installed between the fixed rail unit 1110 and the movable rail unit 1130, the drawer-type doors 120 and 130 can be opened or closed in multiple stages. Further, the rolling balls 1160 are seated and held in a ball retainer 1180.

The mounting bracket 1300 is preferably mounted in the drawer-type storage compartment in the state in which the bracket 1300 supports the fixed rail unit 1110. A mounting plate 1310, having a housing 3600, is formed on the lower portion of the mounting bracket 1300 through bending. Further, the mounting plate 1310 is provided with a locking protrusion 1350 through bending. Thus, both the sliding rail unit 1100 and the housing 3600 are mounted in the storage compartment using one mounting bracket 1300, so that the housing 3600 can be mounted in the storage compartment without changing the structure of a conventional sliding rail unit.

Further, the movable rail unit 1130 is preferably provided with a movable bracket 1500. The movable bracket 1500 has a protrusion 3100, which will be described later herein. A support plate 1510 is formed on the lower end of the movable bracket 1500 through bending, and more securely supports the drawer-type door 120, 130. Thus, the present invention is advantageous in that the two drawer-type doors 120 and 130 can be securely supported and, at the same time, the protrusion 3100 is mounted using the single movable bracket 1500.

Further, as shown in FIG. 20 through FIG. 23, the locking/unlocking unit 3000 includes a protrusion 3100, which is operated in conjunction with the movable rail unit 1130, a locking lever 3300 for locking the protrusion 3100, and an unlocked state retaining unit 4000 for retaining the unlocked state of the protrusion 3100 by rotating the locking lever 3300. The locking lever 3300 is provided with a locking slot 3310, into or from which the protrusion 3100 is inserted or released. As shown in FIG. 21, the locking slot 3310 is configured as a notch, which is defined by a front step 3310*a* and a rear step 3310*b* having different heights. Here, the front step 3310*a* is lower than the rear step 3310*b*. Thus, when the protrusion 3100 is removed from the locking slot 3310, the protrusion 3100 can smoothly pass over the front step 3310*a*. However, when the protrusion 3100 is inserted into the locking slot 3310, the protrusion 3100 can be inserted into the slot 3310 by the rear step 3310*b* without interference from the front step 3310*a*. In the present invention, the protrusion 3100 is preferably configured as a plate having a rectangular cross-section to correspond to the shape of the locking slot 3310.

Further, an elastic member 3500 is preferably provided in the rail device 100 for elastically biasing the locking lever 3300 rearwards. Due to the elastic member 3500, at the time when the protrusion 3100 is inserted into the locking slot 3310 of the locking lever 3300, the drawer-type door 120, 130 can be automatically closed by the rearward restoring force of the elastic member.

As shown in FIG. 21 and FIG. 23, the unlocked state retaining unit 4000 includes a guide groove 4300, which is longitudinally formed along the housing 3600 provided on the mounting plate 1310; a stop groove 4500, which is formed on the front end of the guide groove 4300 such that it is inclined rearwards and communicates with the guide groove 4300; a hinge shaft 4100 provided on the locking lever 3300; and a stop protrusion 4700, which is provided on the locking lever 3300 and slides along both the guide groove 4300 and the stop groove 4500.

At the rear end of the housing 3600, a fixed bracket unit 3500*a* is preferably provided to support the first end of the elastic member 3500. Further, the second end of the elastic member 3500 is supported by a movable bracket unit 3500*b*, which is movable forwards and rearwards along the housing 3600. The movable bracket unit 3500*b* is preferably provided with a hinge shaft bearing plate 3530*b* for rotatably supporting the hinge shaft 4100 of the locking lever 3300.

The elastic member 3500 may use a coil spring. Further, the opposite ends of the elastic member 3500 may have small diameter parts. The opposite small-diameter parts of the elastic member 3500 are stopped by respective stop rings 3510*a* and 3510*b* of the fixed bracket unit 3500*a* and the movable bracket unit 3500*b*, thus being prevented from undesirably becoming removed from the two bracket units 3500*a* and 3500*b*. Of course, to prevent the elastic member 3500 from being undesirably removed upwards, the opposite ends of the elastic member 3500 are preferably secured to the fixed bracket unit 3500*a* and to the movable bracket unit 3500*b*.

The construction of the coil spring, used as the elastic member 3500, and the construction of the movable bracket unit 3500*b* are shown in FIG. 24 and FIG. 25. The coil spring 3500 includes a small diameter part d, which is defined at a location near each end of the spring 3500, and a large diameter part D, which is defined on a remaining part of the end of the spring 3500 at a location other than that of the small diameter part d. The movable bracket unit 3500*b* includes a stop groove, which comprises a small diameter groove d' and a large diameter groove D'. The small diameter groove d' seats the small diameter part d of the spring 3500 therein, while the large diameter groove D', which is contiguous with the small diameter groove d', seats the large diameter part D of the spring 3500 therein. Because the diameter of the stop groove is increased from the small diameter groove d' to the large diameter groove D', the junction between the two grooves d' and D' functions as a stop ring 3510*b* to reliably prevent the spring from being removed. Further, the large diameter groove D' is provided with upper stoppers 3520*b* for holding the upper portion of the large diameter part D of the spring 3500, thus preventing the large diameter part D from being undesirably removed upwards. Thus, when the large diameter part D of the spring 3500 is placed on and pushed down into the large diameter groove D', the large diameter part D can be inserted into the large diameter groove D' through elastic deformation thereof. However, when no force sufficient to remove the large diameter part D from the large diameter groove D' after passing the large diameter part D over the upper stoppers 3520*b* is applied to the spring 3500, it is almost impossible to remove the large diameter part D from the large diameter groove D'. Thus, the elastic member 3500 can be easily assembled with the movable bracket unit 3500*b*. Further, the elastic member 3500 is not likely to be removed from the bracket unit 3500*b* upwards, forwards or rearwards. Of course, in the same manner as that described for the movable bracket unit 3500*b*, the fixed bracket unit 3500*a* may be provided with a structure that prevents the elastic member 3500 from being undesirably removed therefrom upwards, forwards or rearwards.

Both the hinge shaft 4100 and the stop protrusion 4700 are movably seated in the guide groove 4300. The hinge shaft 4100 is always placed in the guide groove 4300, despite the locked or unlocked state of the protrusion 3100. However, when the protrusion 3100 is unlocked, the stop protrusion 4700 is moved to the stop groove 4500, and rotates the locking lever 3300.

Further, the housing 3600 is preferably provided with a damper 5000. Due to the damper 5000, the drawer-type doors 120 and 130 can perform smooth closing motions while gradually attenuating the elastic force of the elastic member 3500. Described in detail, when the drawer-type doors 120 and 130 are closed, the protrusion 3100 is inserted into the locking slot 3310, and the stop protrusion 4700 is moved from the stop groove 4500 to the guide groove 4300. In the above state, due to the restoring force of the tensioned elastic member 3500, the protrusion 3100 may be quickly pulled rearwards and be impacted due to the quick motion. However, in the present invention, the damper 5000 efficiently absorbs shocks caused by the quick motion.

The damper 5000 includes a cylinder 5100 and a piston rod 5300. The front end of the piston rod 5300 is locked to a rod stop hole 3510 of the movable bracket unit 3500*b*. Thus, when the locking lever 3300 is pulled rearwards, the movable bracket unit 3500*b* is pushed rearwards, and the piston rod 5300 is moved in the same direction. In the above state, the moving speed of the piston rod 5300 is gradually reduced by a shock absorbing function performed by the cylinder 5100.

The housing 3600, which carries the elastic member 3500, the damper 5000, the movable bracket unit 3500*b* and the locking lever 3300 thereon, is mounted to the mounting plate 1310 using a plurality of locking elements 3800. However, when the housing 3600 in the above state is mounted to the mounting plate 1310, a worker is required to align the bolt holes of the housing 3600 to the bolt holes of the mounting plate 1310 while another worker places the housing 3600 relative to the mounting plate 1310. To overcome this problem, the mounting plate 1310 is provided with the locking protrusion 1350 having an L-shaped appearance, while the housing 3600 is provided with a locking piece 3650.

Described in detail, the locking protrusion 1350 includes a vertical part 1330, which is formed by vertically bending a cantilever strap, and a horizontal part 1340, which is defined by horizontally bending the end of the vertical part 1330. Thus, when the locking piece 3650 of the housing 3600 is inserted into the locking protrusion 1350 until it comes into contact with the vertical part 1330, the locking piece 3650 is fitted between the horizontal part 1340 and the mounting plate 1310, so that the housing 3600 can be temporarily held on the mounting plate 1310. The housing 3600 in the above state can be easily mounted to the mounting plate 1310 by one worker without help from another worker, and the alignment of the locking holes of the two elements can be easily executed, thus remarkably simplifying the assembly process.

The rail device 1000 of a drawer-type storage compartment having the above-mentioned construction according to the embodiment of the present invention is operated as follows.

FIG. 20 is a side view of FIG. 18, and illustrates the locked state of the rail device. FIG. 21 is a rear view of the housing of FIG. 20. In FIG. 20 and FIG. 21, the drawer-type doors are in locked states thereof. In the locked state, the protrusion 3100 is in a state of having been inserted into the locking slot 3310, and the elastic member 3500 is not in a tensioned state, while the piston rod 5300 is in a tensioned state.

When the drawer-type door in the above state is pulled forwards, the protrusion 3100 is operated in conjunction with both the locking lever 3300 and the movable bracket unit 3500*b*, and thus it is moved forwards. During the forward movement of the protrusion 3100, the stop protrusion 4700 is moved into the stop groove 4500, the locking lever 3300 is rotated, and the protrusion 3100 is unlocked from the locking slot 3310 (see FIG. 22 and FIG. 23). In the unlocked state, as shown in FIG. 22 and FIG. 23, the elastic member 3500 is in a tensioned state, while the piston rod 5300 is in a released state.

When the drawer-type door is closed, the protrusion 3100 actuates the locking lever 3300, so that the stop protrusion 4700 is moved from the stop groove 4500 to the guide groove 4300. Further, the protrusion 3100 is inserted into the locking slot 3310. In the above state, the tensioned elastic member 3500 elastically pulls the protrusion 3100 rearwards due to its restoring force, so that the drawer-type door can be automatically closed. Further, the released piston rod 5300 becomes shortened in the above state, thus being tensioned and executing a damping function to prevent the drawer-type door from quickly closing.

As shown in FIG. 26, the present invention also provides a structure for opening and closing the drawer-type doors 120 and 130 provided in a product, which includes the drawer-type storage compartments 500 and 600 having the drawer-type doors 120 and 130 to open or close the compartments.

In other words, the present invention is characterized in that each of the drawer-type doors 120 and 130 has a handle grip 26, which is not exposed outside in a closed state of the door, but is selectively exposed outside so as to allow a user to obtain access to the handle grip 26 and easily handle the door. In the present invention, to open each of the drawer-type doors 120 and 130 of the drawer-type storage compartments, a user pushes the upper portion of the drawer-type door 120, 130 with one hand, thus opening part of the upper portion of the drawer-type door 120, 130 forwards through a tilting motion and exposing the handle grip 26 outside. Therefore, the user can easily open the drawer-type door 120, 130 while holding the handle grip 26 in the hand.

As shown in FIG. 29 through FIG. 35, each of the drawer-type doors 120 and 130 according to the present invention has a double door structure. Described in detail, each of the drawer-type doors 120 and 130 includes a tilting door unit 21 and a support door unit 22. The tilting door unit 21 is configured such that, when the upper portion of the drawer-type door 120, 130 is pushed with the hand, the upper portion of the tilting door unit 21 is tilted forwards around a hinge part H provided on the lower end of the tilting door unit 21. The support door unit 22 is assembled with the tilting door unit 21.

Here, as shown in FIG. 31, FIG. 32 and FIG. 34, the support door unit 22 has a flat plate structure having a predetermined thickness and a predetermined shape, and supports a drawer box 30, which defines the drawer-type storage compartment.

The support door unit 22 is placed inside the tilting door unit 21 and is moved forwards and rearwards along with the drawer box 30 in the drawer-type storage compartment when the drawer-type door 120, 130 is opened or closed.

Further, as shown in FIG. 31 through FIG. 33, the tilting door unit 21 is an element that has a structure which covers the front surface of the support door unit 22 and is tilted around a predetermined horizontal axis relative to the support door unit 22. The tilting door unit 21 is rotatably coupled to the support door unit 22 at the lower ends thereof by hinges 23, thus forming a hinge part H. The upper end surface of the tilting door unit 21 is partially depressed to form the handle grip 26, so that a user can pull the tilting door unit 21 forwards while holding the handle grip 26 in one hand.

The hinge 23 is well-known to those skilled in the art, and may use a variety of conventional hinges, which can provide a mechanism capable of allowing the tilting door unit of the present invention to be tilted forwards relative to the support door unit. Further, the hinge 23 used in the present invention preferably has a damper function capable of absorbing shocks during a tilting motion of the tilting door unit 21.

Further, a tilting unit T is provided both on a predetermined portion of the inner surface of the support door unit 22 and on an associated surface of the tilting door unit 21, thus allowing the tilting door unit 21 to be tilted relative to the support door unit 22.

Here, the tilting unit T includes a one-touch latch 25, which is provided on the support door unit 22, and a locker 24, which is provided on the tilting door unit 21 and is engaged with the latch 25.

The latch 25, which is installed on the support door unit 22, is seated in a latch seat 28. When the tilting door unit 21 is assembled with the support door unit 22, the latch 25 of the support door unit 22 corresponds to the locker 24, which is provided on the tilting door unit 21.

In other words, due to the cooperation of the hinge part H, which is formed by the hinges 23 provided between the lower ends of the tilting door unit 21 and the support door unit 22, and the tilting unit T, which includes the latch 25 and the locker 24, the tilting motion of the tilting door unit 21 relative to the support door unit 22 can be executed through a one-touch operation.

Particularly, one example of the structure of the latch 25 provided on the support door unit 22 is shown in FIG. 36. However, the present invention may use another latch structure as an alternative to the structure of the latch 25 shown in FIG. 36 as long as the latch structure can provide a one-touch tilting structure.

Further, the support door unit 22 is provided on the upper end thereof with a plurality of stoppers 27 in order to stop the tilting motion of the tilting door unit 21 relative to the support door unit 22 at a predetermined tilted position Thus, when the tilting door unit 21 is tilted forwards relative to the support door unit 22, the stoppers 27 prevent the upper end of the tilting door unit 21 from being excessively separated from the upper end of the support door unit 22.

Hereinbelow, the opening/closing operation of the drawer-type door having the above-mentioned opening/closing structure according to the present invention will be described.

When it is desired to open the closed drawer-type doors 120 and 130 shown in FIG. 26, a user must open the drawer-type doors 120 and 130 while holding the handle grips 26 in the hands.

However, as shown in FIG. 26, in the closed state of the drawer-type doors 120 and 130 of the product according to the present invention, the handle grips 26 are not exposed outside, and thus the user cannot obtain access to the handle grips 26 and cannot open the drawer-type doors 120 and 130.

Thus, to open the closed drawer-type doors 120 and 130 shown in FIG. 26, the drawer-type doors 120 and 130 of the present invention are configured such that when they are tilted forwards, the handle grips 26 are exposed outside.

Described in detail, to open the closed drawer-type door 120, 130, the user slightly pushes the closed drawer-type door 120, 130 rearwards, so that the one-touch latch 25 of the support door unit 22 is released from the locker 24 of the tilting door unit 21 and a tilting motion is started, as shown in FIG. 27. Due to the tilting motion, the tilting door unit 21 is tilted forwards around the hinges 23 of the hinge part H, provided between the lower ends of the tilting door unit 21 and the support door unit 22, so that the upper part of the tilting door unit 21 is slightly ejected forwards and is slightly opened.

Due to the tilting motion, the handle grip 26, provided on the upper end surface of the tilting door unit 21, is exposed outside, and the user obtains access to the handle grip 26. Thus, the user can hold the handle grip 26 in one hand and pull the drawer-type door 120, 130 forwards until the drawer-type door 120, 130 is opened to a desired extent, as shown in FIG. 28.

As described above, in a product having the drawer-type doors 120 and 130 according to the present invention, the handle grip 26 of each of the drawer-type doors 120 and 130 is provided on the upper end surface of the tilting door unit 21, capable of executing a tilting motion relative to the support door unit 22, such that the handle grip 26 is not exposed outside in a normal state, but is selectively exposed outside through the tilting motion of the tilting door unit 21 relative to the support door unit 22. Described in brief, the present invention provides a new structure for opening or closing the drawer-type doors 120 and 130, which are configured such that the drawer-type doors 120 and 130 can be easily opened through the tilting motion.

Although an embodiment of the present invention has been described for illustrative purposes, those skilled in the art will appreciate that various modifications, additions and substitutions are possible, without departing from the scope and spirit of the invention as disclosed in the accompanying claims.

As apparent from the above description, the food refrigerator according to the present invention has the following advantages.

The present invention relates to a food refrigerator, which includes a bracket for coupling a plurality of refrigerator units to each other. Thus, the present invention allows a user to easily couple the refrigerator units to each other after rearranging the refrigerator units as desired, thus improving the utility of the food refrigerator.

The food refrigerator may include a first refrigerator unit and a second refrigerator unit. When the first refrigerator unit and the second refrigerator unit are arranged side by side, the bracket is placed between the first and second refrigerator units such that the bracket extends from the front to the back of the refrigerator units. In the above state, the front end of the bracket is mounted to the first refrigerator unit, while the rear end is mounted to the second refrigerator unit, so that the first and second refrigerator units, arranged horizontally, can be easily coupled to each other by the bracket.

The bracket is provided with a first locking hole in the front end thereof. Further, a second locking hole is longitudinally formed along the rear end of the bracket such that it extends in a direction from the front to the back of the refrigerator units. Thus, the bracket can couple two refrigerator units to each other such that the interval between the two refrigerator units is adjustable.

The refrigerator units may include a first refrigerator unit, having a machine room, and a second refrigerator unit, placed adjacent to the first refrigerator unit. A machine room bracket, provided with a locking part on an edge thereof through bending, is installed in the machine room. The locking part of the machine room bracket is connected to the second refrigerator unit, thus stably coupling the two refrigerator units to each other in addition to holding machines in the machine room.

The machine room bracket is provided with a plurality of locking parts such that the locking parts are oriented in several directions, so that the second refrigerator unit can be placed at a desired location relative to the first refrigerator unit and the first and second refrigerator units can be efficiently coupled to each other.

Further, the present invention provides a locking/unlocking unit for locking or unlocking a movable rail unit. Thanks to the locking/unlocking unit, it is not necessary for a user to check whether the drawer-type doors are closed or not. Further, the locking/unlocking unit prevents the drawer-type doors from being undesirably opened.

The locking/unlocking unit includes a protrusion, which is operated in conjunction with the movable rail unit; a locking lever having a locking slot for locking the protrusion when the protrusion moves rearwards; an elastic member for elastically biasing the locking lever rearwards; and an unlocked state retaining unit for retaining the unlocked state of the protrusion by rotating the locking lever when the protrusion moves forwards Thus, the protrusion, which is locked to the locking lever, can be elastically pulled rearwards by the elastic member, so that the present invention provides a function of automatically closing the drawer-type doors.

Further, the unlocked state retaining unit includes a housing having a fixed bracket unit for supporting the first end of the elastic member; a movable bracket unit holding the second end of the elastic member and being movable forwards and rearwards; a guide groove longitudinally formed along the housing; a stop groove formed on the front end of the guide groove such that the stop groove is inclined rearwards and communicates with the guide groove; a hinge shaft provided on the locking lever and rotatably coupled to the movable bracket unit; and a stop protrusion provided on the locking lever such that it slides along both the guide groove and the stop groove. Thus, when the drawer-type door is opened, the locking lever is locked to the stop protrusion.

Further, the elastic member is a coil spring, in which the diameter of a part (small diameter part) near each end of the spring is less than that of a remaining part (large diameter part) of the end. Further, each of the fixed bracket unit and the movable bracket unit includes a small diameter groove, which seats therein the small diameter part of the spring, and a large diameter groove, which communicates with the small diameter groove and seats therein the large diameter part of the spring. Thus, the elastic member can be easily assembled with the fixed and movable bracket units, and is prevented from being undesirably removed forwards or rearwards.

Further, the large diameter groove is provided with upper stoppers for holding the upper portion of the large diameter part of the spring, thus preventing the large diameter part from being undesirably removed upwards from the large diameter groove.

Further, the movable rail unit is provided with a mounting bracket, which holds the movable rail unit and is mounted to the inner casing of each of the drawer-type storage compartments. The mounting bracket has a mounting plate, which is mounted to the housing. The mounting plate includes a locking protrusion, which is formed by cutting a cantilever strap from the mounting plate and by bending the cantilever strap into an L shape, while the housing is provided with a locking piece that can be engaged with the locking protrusion. Thus, the housing can be quickly and stably assembled with the mounting plate in the state in which the housing is temporarily assembled with the mounting plate, so that work efficiency during an assembling process is improved.

Further, the present invention may have a damper for reducing the rearward moving speed of the locking lever while gradually attenuating the restoring force of the elastic member. Thus, when the drawer-type doors are closed, the doors can be prevented from unexpected collision with the casing of the refrigerator units.

Further, the movable rail unit is provided with a movable bracket, on which the protrusion is mounted. When the movable bracket is provided with a support plate for supporting the drawer-type door, it is possible to easily mount the protrusion to a conventional movable rail unit and to securely support the drawer-type doors.

Further, to open the door of a drawer-type storage compartment in a product having the storage compartment, the upper portion of the door is pushed rearwards with one hand so as to open a part of the upper portion of the door forwards through a tilting motion. Thus, a handle grip, which is provided on the upper end surface of the door and is not exposed outside in the closed state of the door, is exposed outside, and allows a user to open the door while holding the handle grip with a hand. Thanks to the hidden handle grip, a variety of products having a good appearance can be provided.

What is claimed is:

1. A food refrigerator, comprising:

a first refrigerator unit having a first storage compartment, a second storage compartment and a machine compartment, the first storage compartment delimited by a front surface, a back surface, a left side surface, a right side surface, a bottom surface and a first upper door, a first control panel on the front surface, a hinge attached to the first upper door and the back surface, the first upper door rotatable on the hinge such that the first upper door can be opened and closed vertically, and a deodorizer and a lamp fixed to an inner surface of the first upper door and facing inwardly to the first storage compartment, the second storage compartment positioned vertically below the first storage compartment, the second storage compartment being a drawer which slides horizontally forwards and backwards, and the machine compartment having an open recess in a rear surface of the second storage compartment;

an accessory storage compartment fixed horizontally adjacent the first storage compartment, the accessory storage compartment having a second upper door hinged on a back surface of the accessory storage compartment, the second upper door being rotatable on the hinge such that the second upper door can be opened and closed vertically;

a second refrigerator unit connected horizontally adjacent to the first refrigerator unit, the second refrigerator unit having a third storage compartment and a fourth storage compartment, the third storage compartment positioned vertically below the accessory storage compartment, the third storage compartment having racks therein, the third storage compartment having an upper surface, a lower surface, a left side surface and a right side surface, a first front side door being hinged to the left side surface, the first front side door being rotatable on the hinge such that the first front side door can be opened and closed horizontally, and a second control unit fixed to the lower surface of the first front side door, the fourth storage compartment being a drawer positioned below the third storage compartment, the drawer slides horizontally forwards and backwards, a sliding rail unit comprising a fixed rail unit, mounted to an inner casing of the second storage compartment, and a movable rail unit movably mounted to the fixed rail unit and operated in conjunction with the fourth storage compartment; and a locking/unlocking unit for locking and unlocking the movable rail unit in forward and rearward direction.

2. The food refrigerator as claimed in claim 1, further comprising:

a bracket for coupling the first refrigerator unit and the second refrigerator unit to each other.

3. The food refrigerator as claimed in claim 2, wherein the bracket is placed between the first refrigerator unit and the second refrigerator unit such that the bracket extends from a front to a back of the refrigerator units, wherein a front end of the bracket is connected to the first refrigerator unit and a rear end of the bracket is connected to the second refrigerator unit.

4. The food refrigerator as claimed in claim 3, wherein the bracket is provided with a first locking hole in the front end thereof and a second locking hole in the rear end thereof, the second locking hole being longitudinally formed in a direction from the front to the back of the refrigerator units.

5. The food refrigerator as claimed in claim 2, wherein the machine compartment has a machine compartment bracket installed in the machine compartment and provided with a locking part on an edge thereof through bending, and wherein the locking part of the machine compartment bracket is connected to the second refrigerator unit.

6. The food refrigerator as claimed in claim 5, wherein the locking part of the machine compartment is bent in each of four directions.

7. The food refrigerator as claimed in claim 1, wherein the locking/unlocking unit comprises:

a protrusion operated in conjunction with the movable rail unit;

a locking lever having a locking slot for locking the protrusion during rearward movement of the protrusion;

an elastic member for elastically biasing the locking lever rearwards; and an unlocked state retaining unit for retaining an unlocked state of the protrusion by rotating the locking lever during forward movement of the protrusion.

8. The food refrigerator as claimed in claim 7, wherein the unlocked state retaining unit comprises:

a housing having a fixed bracket unit for holding a first end of the elastic member;

a movable bracket unit holding a second end of the elastic member and being movable forwards and rearwards;

a guide groove longitudinally formed along the housing;

a stop groove formed in a front end of the guide groove such that the stop groove is inclined rearwards;

a hinge shaft provided on the locking lever and rotatably coupled to the movable bracket unit; and a stop protrusion provided on the locking lever so as to slide along both the guide groove and the stop groove.

9. The food refrigerator as claimed in claim 8, wherein the elastic member is a coil spring, in which a diameter of a part, which is a small diameter part, near each end of the coil spring is less than that of a remaining part, which is a large diameter part, of the end, and each of the fixed bracket unit and the movable bracket unit includes a small diameter groove for seating the small diameter part of the coil spring therein, and a large diameter groove, which communicates with the small diameter groove and seats the large diameter part of the coil spring therein.

10. The food refrigerator as claimed in claim 9, wherein the large diameter groove is provided with upper stoppers for holding an upper portion of the large diameter part of the coil spring.

11. The food refrigerator as claimed in claim 10, wherein the sliding rail unit is provided with a mounting bracket, which holds the fixed rail unit and is mounted to the inner casing of each of the drawer-type storage compartments, wherein the mounting bracket is provided with a mounting plate to be mounted to the housing, wherein the mounting plate includes a locking protrusion formed by cutting a cantilever strap from the mounting plate and by bending the cantilever strap into an L shape, and wherein the housing is provided with a locking piece to be engaged with the locking protrusion.

12. The food refrigerator as claimed in claim 7, further comprising:

a damper for reducing a rearward moving speed of the locking lever, which is moved by a restoring force of the elastic member.

13. The food refrigerator as claimed in claim 12, wherein the movable rail unit is provided with a movable bracket, on which the protrusion is mounted, and wherein the movable bracket is provided with a support plate for supporting the second storage compartment and the fourth storage compartment.

14. The food refrigerator as claimed in claim 1, wherein the door of the second storage compartment has a double door structure comprising a tilting door unit, placed at a front location and tilted forwards around a hinge part provided on a lower end thereof, and a support door unit, placed at a rear location and covered with the tilting door unit, wherein a tilting unit is provided between the tilting door unit and the support door unit for executing a tilting motion, so that, when an upper portion of the door is pushed with a hand, part of the upper portion of the door is tilted forwards by operation of the tilting unit, thus exposing a handle grip, which was previously hidden, outside.

15. The food refrigerator as claimed in claim 14, wherein the hinge part comprises a hinge for coupling the tilting door unit and the support door unit to each other, and the tilting unit comprises a one-touch latch, provided on the support door unit, and a locker provided on the tilting door unit so as to be engaged with the latch.

16. The food refrigerator as claimed in claim 15, wherein the support door unit is provided on an upper end thereof with a plurality of stoppers so as to prevent an upper end of the tilting door unit from being excessively separated from the upper end of the support door unit when the tilting door unit is tilted forwards relative to the support door unit.

* * * * *